US012320363B2

(12) United States Patent
Teramoto et al.

(10) Patent No.: US 12,320,363 B2
(45) Date of Patent: Jun. 3, 2025

(54) CENTRIFUGAL AIR-SENDING DEVICE AND AIR-CONDITIONING APPARATUS

(71) Applicant: Mitsubishi Electric Corporation, Tokyo (JP)

(72) Inventors: Takuya Teramoto, Tokyo (JP); Hiroyasu Hayashi, Tokyo (JP); Ryo Horie, Tokyo (JP); Yoshitaka Akari, Saitama (JP); Takashi Yamaguchi, Tokyo (JP); Kazuya Michikami, Tokyo (JP); Takahiro Yamatani, Tokyo (JP); Masahiko Takagi, Tokyo (JP); Kazuki Watanabe, Tokyo (JP); Hidetoshi Seki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 231 days.

(21) Appl. No.: 18/044,091

(22) PCT Filed: Oct. 22, 2020

(86) PCT No.: PCT/JP2020/039665
§ 371 (c)(1),
(2) Date: Mar. 6, 2023

(87) PCT Pub. No.: WO2022/085143
PCT Pub. Date: Apr. 28, 2022

(65) Prior Publication Data

US 2023/0323892 A1 Oct. 12, 2023

(51) Int. Cl.
*F04D 29/30* (2006.01)
*F04D 17/08* (2006.01)
(Continued)

(52) U.S. Cl.
CPC ..... *F04D 29/30* (2013.01); *F04D 17/08* (2013.01); *F04D 29/4206* (2013.01); *F04D 29/582* (2013.01); *F24F 1/0022* (2013.01)

(58) Field of Classification Search
CPC ..... F04D 29/30; F04D 17/08; F04D 29/4206; F04D 29/582; F24F 1/0022
(Continued)

(56) References Cited

U.S. PATENT DOCUMENTS 5,964,576 A * 10/1999 Fujita ..... F04D 29/282 416/185
6,007,300 A * 12/1999 Saeki ..... F04D 29/30 416/178
(Continued)

FOREIGN PATENT DOCUMENTS

CN 111237251 A 6/2020
JP H10-037894 A 2/1998
(Continued)

OTHER PUBLICATIONS

Office Action dated Aug. 22, 2023 issued in corresponding JP Patent Application No. 2022-556320 (and English translation).
(Continued)

*Primary Examiner* — Jon T. Schermerhorn, Jr.
(74) *Attorney, Agent, or Firm* — Posz Law Group, PLC

(57) ABSTRACT

A centrifugal air-sending device has blades that each have a vane length in a first region that is greater than a vane length in a second region, and are each formed such that a proportion for which a turbo vane portion accounts is higher in a radial direction than a proportion for which a sirocco vane portion accounts in the first region and the second region. The blades that are located closer to an outer circumference than is a blade inner diameter of inner circumferential ends of the blades at end portions of the blades that are close to
(Continued)

a side plate in an axial direction are defined as a blade outer circumferential portion that is formed such that a vane thickness of each of the blades in decreased in the radial direction from an inner circumference toward the outer circumference.

9 Claims, 28 Drawing Sheets

(51) Int. Cl.
*F04D 29/42* (2006.01)
*F04D 29/58* (2006.01)
*F24F 1/0022* (2019.01)

(58) Field of Classification Search
USPC ..... 165/122
See application file for complete search history.

(56) References Cited

U.S. PATENT DOCUMENTS

| | | | | |
|---|---|---|---|---|
| 8,011,891 | B2 * | 9/2011 | Ochiai | F04D 29/282 416/243 |
| 8,215,918 | B2 * | 7/2012 | Hwang | F04D 29/681 416/231 B |
| 10,527,054 | B2 * | 1/2020 | Orangi | F04D 29/30 |
| 11,773,864 | B2 * | 10/2023 | Son | F04D 29/242 415/203 |
| 11,835,058 | B2 * | 12/2023 | Honda | F04D 29/30 |
| 12,152,600 | B2 * | 11/2024 | Teramoto | F04D 29/288 |
| 2010/0115983 | A1 * | 5/2010 | Ikeda | F04D 29/30 415/203 |
| 2016/0290353 | A1 * | 10/2016 | Kasahara | F04D 29/30 |
| 2021/0033104 | A1 * | 2/2021 | Teramoto | F04D 29/4226 |
| 2022/0106968 | A1 * | 4/2022 | Teramoto | F04D 29/422 |
| 2022/0412372 | A1 * | 12/2022 | Teramoto | F04D 29/4226 |

FOREIGN PATENT DOCUMENTS

| | | | |
|---|---|---|---|
| JP | H10-306796 | A | 11/1998 |
| JP | 2000-240590 | A | 9/2000 |
| JP | 2005-155580 | A | 6/2005 |
| JP | 2006-063812 | A | 3/2006 |
| JP | 2007-127089 | A | 5/2007 |
| JP | 2009-203897 | A | 9/2009 |
| JP | 2011-226410 | A | 11/2011 |
| JP | 2012-202368 | A | 10/2012 |
| TW | 202020309 | A | 6/2020 |
| WO | 2008/111368 | A1 | 9/2008 |
| WO | 2013/080241 | A1 | 6/2013 |
| WO | 2015/087909 | A1 | 6/2015 |

OTHER PUBLICATIONS

Extended European Search Report dated Nov. 10, 2023 issued in corresponding European Patent Application No. 20958695.7.
Office Action dated Dec. 12, 2023 issued in corresponding JP Patent Application No. 2022-556320 (and English translation).
International Search Report of the International Searching Authority mailed Jan. 19, 2021 for the corresponding International Application No. PCT/JP2020/039665 (and English translation).
Office Action issued May 4, 2022 in corresponding TW Patent Application No. 110114081 (and English machine translation).
Office Action issued Oct. 19, 2022 in corresponding TW Patent Application No. 110114081 (and English machine translation).
Office Action issued Jan. 24, 2025 in corresponding CN Patent Application No. 202080106264.9 (and partial English translation).

* cited by examiner

Comparative Example

CENTRIFUGAL AIR-SENDING DEVICE AND AIR-CONDITIONING APPARATUS

CROSS REFERENCE TO RELATED APPLICATION

This application is a U.S. national stage application of PCT/JP2020/039665 filed on Oct. 22, 2020, the contents of which are incorporated herein by reference.

TECHNICAL FIELD

The present disclosure relates to a centrifugal air-sending device that includes an impeller and an air-conditioning apparatus that includes the centrifugal air-sending device.

BACKGROUND ART

There has been a centrifugal air-sending device that has a scroll casing that is scroll-shaped and has a bell mouth formed at an air inlet and an impeller that is installed in the scroll casing and is configured to rotate about an axial center (refer to, for example, Patent Literature 1). The impeller disclosed in Patent Literature 1 and included in the centrifugal air-sending device has a main plate that is disk-shaped, a side plate that is ring-shaped, and blades radially arranged. The blades included in this impeller are arranged such that their inner diameter increases from the main plate toward the side plate. The blades also are sirocco vanes, which are forward-curved blades, and that each have a blade outlet angle of greater than or equal to 100 degrees and have inducer portions of turbo vanes, which are backward-curved blades, at an inner circumference of the blades.

CITATION LIST

Patent Literature

Patent Literature 1: Japanese Unexamined Patent Application Publication No. 2000-240590

SUMMARY OF INVENTION

Technical Problem

In a case in which an impeller is resin-molded, to prevent its side plate from sticking to a mold, such a side plate has been ring-shaped and provided to outer circumferential side face of the impeller. In a centrifugal air-sending device that has an impeller that has such a configuration, an airflow blown in a radial direction of the impeller may pass outward around the side plate as its center and along an inner side surface of a bell mouth and flow into the impeller again. In the centrifugal air-sending device disclosed in Patent Literature 1, portions of blades that are located further outward than an inner circumferential side end portion of the bell mouth are formed only by portions formed as sirocco vane portions. When an airflow blown out from the impeller and along an inner wall surface of the bell mouth flows into the impeller again, the airflow thus collides with the sirocco vane portions, which each have a large outlet angle and at which the airflow passes at increased inflow velocity. Noise generated from the centrifugal air-sending device may be thus caused and deterioration in input may be caused as well.

The present disclosure is to solve the above problem and to provide a centrifugal air-sending device, in which, when an airflow that passes along the inner wall surface of the bell mouth passes into the impeller again, noise generated from the airflow and deterioration in input are prevented, and an air-conditioning apparatus that includes the centrifugal air-sending device.

Solution to Problem

A centrifugal air-sending device according to an embodiment of the present disclosure has an impeller that has a main plate that is to be driven to rotate, a side plate that is ring-shaped and located such that the side plate faces the main plate, and a plurality of blades that each have one end connected to the main plate and an other end connected to the side plate and are arranged in a circumferential direction centered on a rotation axis of the main plate that is virtual; and a scroll casing that houses the impeller and has a circumferential wall that is scroll-shaped and a side wall that has a bell mouth that forms a suction port that communicates with a space defined by the main plate and the plurality of blades, in which the plurality of blades each have an inner circumferential end that is closer to the rotation axis than is an outer circumferential end in a radial direction centered on the rotation axis, the outer circumferential end that is closer to an outer circumference than is the inner circumferential end in the radial direction, a sirocco vane portion that includes the outer circumferential end and forms a forward-curved blade at which an outlet angle is formed larger than 90 degrees, a turbo vane portion that includes the inner circumferential end and forms a backward-curved blade, a first region that is located closer to the main plate than is an intermediate position between the main plate and the side plate in an axial direction of the rotation axis, and a second region that is located closer to the side plate than is the first region, the plurality of blades each have a vane length in the first region that is greater than a vane length in the second region, the plurality of blades are each formed such that a proportion for which the turbo vane portion accounts is higher in the radial direction than a proportion for which the sirocco vane portion accounts in the first region and the second region, and, in a case in which portions of the plurality of blades that are located closer to the outer circumference than is a blade inner diameter of the respective inner circumferential ends of the plurality of blades at end portions of the plurality of blades that are close to the side plate in the axial direction are defined as a blade outer circumferential portion, the blade outer circumferential portion is formed such that a vane thickness of each of the plurality of blades is decreased in the radial direction from an inner circumference toward the outer circumference.

An air-conditioning apparatus according to another embodiment of the present disclosure has the centrifugal air-sending device, which has a configuration described above.

Advantageous Effects of Invention

According to an embodiment of the present disclosure, the blade outer circumferential portion of the centrifugal air-sending device is formed such that the vane thickness of each of the plurality of blades is decreased in the radial direction from the inner circumference toward the outer circumference. In the centrifugal air-sending device, vane intervals in the impeller are thus each gradually increased and an opening area of each of the vane intervals is also increased toward discharge ports of the blades. The centrifugal air-sending device that has the configuration described above is configured to further reduce rapid pressure fluctuation when air is blown out from the impeller and increase the amount of air blown out from the impeller in comparison with a centrifugal air-sending device that does not have the configuration described above. As a result, much air blown out from the impeller in the centrifugal air-sending device that has the configuration described above passes along an inner wall surface of the bell mouth into a portion of the impeller that is at the inner circumference and collides with the turbo vane portions, which each have a small outlet angle and at which an airflow passes at decreased inflow velocity. In the centrifugal air-sending device, when the airflow that passes along the inner wall surface of the bell mouth passes into the impeller again, since the airflow collides with the turbo vane portions, which each have a small outlet angle and at which the airflow passes at decreased inflow velocity, noise generated from the airflow is prevented and deterioration in input is prevented as well.

DESCRIPTION OF EMBODIMENT

Figure 1:
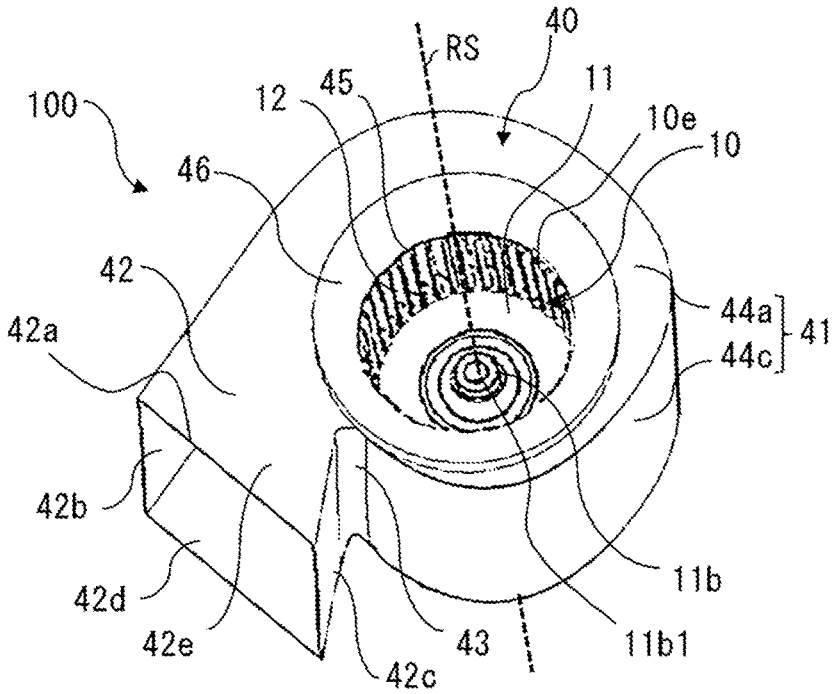
FIG. 1 is a perspective view that schematically illustrates a centrifugal air-sending device according to Embodiment 1.

A centrifugal air-sending device and an air-conditioning apparatus according to embodiments are described below with reference to the drawings and other reference. In the drawings below, which include FIG. 1, the relative dimensions, shapes, and other details of various components may differ from those of the actual components. In addition, components given the same reference signs in the following drawings are the same as or equivalent to each other, and these reference signs are common through the full text of the specification. In addition, the directional terms, such as "upper", "lower", "right", "left", "front", and "back", used as appropriate for ease of comprehension are merely so written for convenience of explanation, and the placement or orientation of a device or a component is not limited by the directional terms.

Embodiment 1

Centrifugal Air-Sending Device 100

Figure 2:
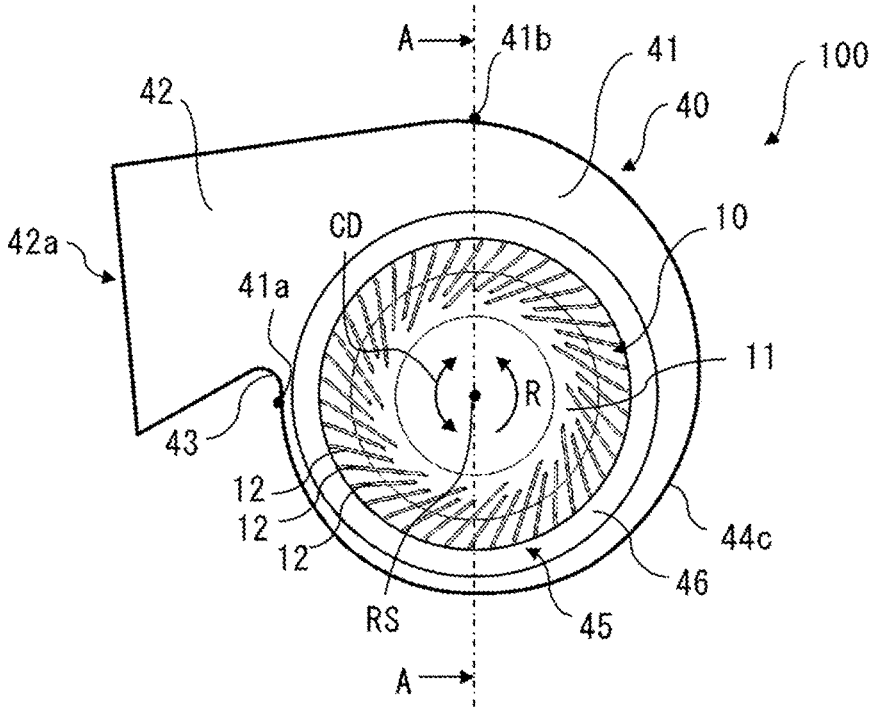
FIG. 2 is an external view that schematically illustrates a configuration of the centrifugal air-sending device according to Embodiment 1 with the configuration viewed parallel to a rotation axis.
Figure 3:
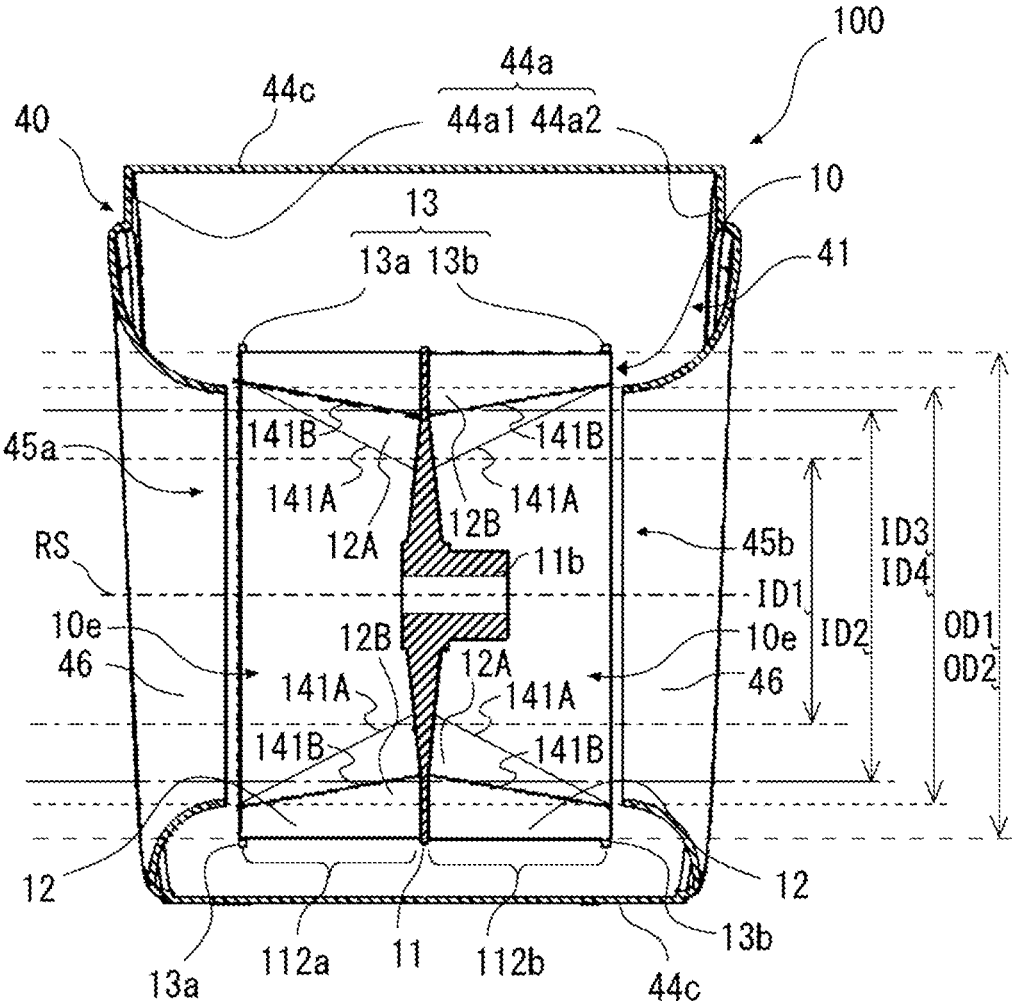
FIG. 3 is a sectional view that schematically illustrates a section of the centrifugal air-sending device illustrated in FIG. 2 taken along line A-A.

FIG. 1 is a perspective view that schematically illustrates a centrifugal air-sending device 100 according to Embodiment 1. FIG. 2 is an external view that schematically illustrates a configuration of the centrifugal air-sending device 100 according to Embodiment 1 with the configuration viewed parallel to a rotation axis RS. FIG. 3 is a sectional view that schematically illustrates a section of the centrifugal air-sending device 100 illustrated in FIG. 2 taken along line A-A. A basic structure of the centrifugal air-sending device 100 is described below with reference to FIG. 1 to FIG. 3.

The centrifugal air-sending device 100 is a multi-blade air-sending device and has an impeller 10 configured to generate an airflow and a scroll casing 40, which houses the impeller 10. The centrifugal air-sending device 100 is also a double-suction centrifugal air-sending device through which air is sucked from both sides of the scroll casing 40 in an axial direction of the rotation axis RS, which is virtual, of the impeller 10.

Scroll Casing 40

The scroll casing 40 houses the impeller 10 for the centrifugal air-sending device 100 and rectifies air blown out from the impeller 10. The scroll casing 40 has a scroll portion 41 and a discharge portion 42.

Scroll Portion 41

The scroll portion 41 forms an air passage through which a dynamic pressure of an airflow generated by the impeller 10 is converted into a static pressure. The scroll portion 41 has side walls 44*a* that each cover the impeller 10 in the axial direction of the rotation axis RS of the boss portion 11*b* included in the impeller 10 and each have a suction port 45 formed in the side wall 44*a* and through which air is sucked and a circumferential wall 44*c* that surrounds the impeller 10 in radial directions from the rotation axis RS of the boss portion 11*b*.

In addition, the scroll portion 41 has a tongue portion 43, located between a discharge portion 42 and a scroll start portion 41*a* of the circumferential wall 44*c*, that has a curved surface and guides an airflow generated by the impeller 10 toward a discharge port 42*a* through the scroll portion 41. The radial directions from the rotation axis RS are each a direction perpendicular to the rotation axis RS. The scroll portion 41 has an internal space, defined by the circumferential wall 44*c* and the side walls 44*a*, in which air blown out from the impeller 10 flows along the circumferential wall 44*c*.

Side Walls 44*a*

The side walls 44*a* are located at both respective faces of the impeller 10 in the axial direction of the rotation axis RS of the impeller 10. The side walls 44*a* of the scroll casing 40 each have the suction port 45 formed in the side wall 44*a* such that air is allowed to flow between the impeller 10 and an outside of the scroll casing 40.

The suction port 45 is formed in a circular shape and the impeller 10 is located such that the center of the suction port 45 and the center of the boss portion 11*b* of the impeller 10 substantially coincide with each other. The shape of the suction port 45 is not limited to the circular shape and may also be another shape, such as an elliptical shape.

The scroll casing 40 of the centrifugal air-sending device 100 is a double-suction casing that has the side walls 44*a*, which have the respective suction ports 45 at both faces of the main plate 11 in the axial direction of the rotation axis RS of the boss portion 11*b*.

The centrifugal air-sending device 100 has the two side walls 44*a* in the scroll casing 40. The two side walls 44*a* are formed such that the side walls 44*a* face each other across the circumferential wall 44*c*. More specifically, as illustrated in FIG. 3, the scroll casing 40 has a first side wall 44*a*1 and a second side wall 44*a*2 as the side walls 44*a*.

The first side wall 44*a*1 has a first suction port 45*a* formed in the first side wall 44*a*1. The first suction port 45*a* faces a plate surface of the main plate 11 on which a first side plate 13*a*, which is described later, is located. The second side wall 44*a*2 has a second suction port 45*b* formed in the second side wall 44*a*2. The second suction port 45*b* faces a plate surface of the main plate 11 on which a second side plate 13*b*, which is described later, is located. The first suction port 45*a* and the second suction port 45*b* are collectively referred to as the suction ports 45 described above.

The suction port 45 located in the side wall 44*a* is formed by a bell mouth 46. The bell mouth 46 forms the suction port 45, which communicates with a space defined by the main plate 11 and a plurality of blades 12. The bell mouth 46 rectifies a flow of gas to be sucked into the impeller 10 and causes the gas to flow into the air inlet 10*e* of the impeller 10.

The bell mouth 46 has an opening of which a diameter gradually decreases from the outside toward the inside of the scroll casing 40. Such a configuration of each of the side walls 44*a* allows air around the suction ports 45 to smoothly flow along the bell mouths 46 and efficiently flow from the suction ports 45 into the impeller 10.

Circumferential Wall 44*c*

The circumferential wall 44*c* is a wall that has a curved wall surface along which an airflow generated by the impeller 10 is guided toward the discharge port 42*a*. The circumferential wall 44*c* is located between the side walls 44*a*, which face each other, and forms a curved surface that extends along the rotation direction R of the impeller 10. The circumferential wall 44*c* is located, for example, parallel to the axial direction of the rotation axis RS of the impeller 10 and covers the impeller 10. The circumferential wall 44*c* may also be shaped such that the circumferential wall 44*c* is inclined to the axial direction of the rotation axis RS in the impeller 10 and is not limited to be located parallel to the axial direction of the rotation axis RS.

The circumferential wall 44*c* has an inner circumferential surface that covers the impeller 10 in the radial directions of the boss portion 11*b* and faces the plurality of blades 12, which are described later. The circumferential wall 44*c* faces air outlets of the blades 12 in the impeller 10. As illustrated in FIG. 2, the circumferential wall 44*c* is located over an area from the scroll start portion 41*a* located at a boundary between the circumferential wall 44*c* and the tongue portion 43 to a scroll end portion 41*b* located at a boundary between the scroll portion 41 and an end of the discharge portion 42 that is located farthest from the tongue portion 43 along the rotation direction R of the impeller 10.

The scroll start portion 41*a* is an upstream end portion of the circumferential wall 44*c*, which forms a curved surface, in a direction in which gas is caused by rotation of the impeller 10 to flow along the circumferential wall 44*c* in an internal space in the scroll casing 40. The scroll end portion 41*b* is a downstream end portion of the circumferential wall 44*c*, which forms the curved surface, in the direction in which gas is caused by rotation of the impeller 10 to flow along the circumferential wall 44*c* in the internal space in the scroll casing 40.

The circumferential wall 44*c* is formed in a spiral shape. The spiral shape is, for example, a shape formed by a logarithmic spiral, an Archimedean spiral, or an involute curve. The inner circumferential surface of the circumferential wall 44*c* has the curved surface, which is smoothly curved along a circumferential direction of the impeller 10 from the scroll start portion 41*a*, which is a starting end of the spiral shape, to the scroll end portion 41*b*, which is a terminating end of the spiral shape. Such a configuration allows air sent out from the impeller 10 to smoothly flow through a gap between the impeller 10 and the circumferential wall 44*c* in a direction toward the discharge portion 42. A static pressure of air from the tongue portion 43 toward the discharge portion 42 in the scroll casing 40 thus efficiently increases.

Discharge Portion 42

The discharge portion 42 forms the discharge port 42*a* through which an airflow that is generated by the impeller 10 and has passed through the scroll portion 41 is discharged. The discharge portion 42 is formed by a hollow pipe that has a rectangular section orthogonal to a direction in which air flows along the circumferential wall 44*c*. Such a sectional shape of the discharge portion 42 is not limited to a rectangular shape. The discharge portion 42 forms a flow passage through which air that is sent out from the impeller 10 and flows through the gap between the circumferential wall 44*c* and the impeller 10 is guided to be discharged out from the scroll casing 40.

As illustrated in FIG. 1, the discharge portion 42 is formed by an extension plate 42*b*, a diffuser plate 42*c*, a first side plate portion 42*d*, a second side plate portion 42*e*, and other components. The extension plate 42*b* is formed integrally with the circumferential wall 44*c* such that the extension plate 42*b* smoothly continues to the scroll end portion 41*b*, which is located downstream of the circumferential wall 44*c*. The diffuser plate 42*c* is formed integrally with the tongue portion 43 of the scroll casing 40 and faces the extension plate 42*b*. The diffuser plate 42*c* is formed at a predetermined angle to the extension plate 42*b* such that a sectional area of the flow passage gradually increases along a direction in which air flows in the discharge portion 42.

The first side plate portion 42*d* is formed integrally with the first side wall 44*a*1 of the scroll casing 40, and the second side plate portion 42*e* is formed integrally with the second side wall 44*a*2 of the scroll casing 40, which is located opposite to the first side wall 44*a*1. The first side plate portion 42*d* and the second side plate portion 42*e* are formed between the extension plate 42*b* and the diffuser plate 42*c*. The discharge portion 42 thus has a rectangular-sectional flow passage defined by the extension plate 42*b*, the diffuser plate 42*c*, the first side plate portion 42*d*, and the second side plate portion 42*e*.

Tongue Portion 43

In the scroll casing 40, the tongue portion 43 is formed between the diffuser plate 42*c* of the discharge portion 42 and the scroll start portion 41*a* of the circumferential wall 44*c*. The tongue portion 43 is formed with a predetermined radius of curvature such that the circumferential wall 44*c* is smoothly connected to the diffuser plate 42*c* through the tongue portion 43.

The tongue portion 43 reduces inflow of air from a scroll ending portion to a scroll starting portion of the flow passage, which is spiral-shaped. The tongue portion 43 is located upstream in an air duct and separates an airflow along the rotation direction R of the impeller 10 and an airflow from a downstream portion in the air duct toward the discharge port 42*a*. In addition, while an airflow is passing through the scroll casing 40, the airflow, which then passes into the discharge portion 42, rises in static pressure to be higher in pressure than the airflow in the scroll casing 40. For this reason, the tongue portion 43 is formed to separate such different pressures.

Impeller 10

Figure 4:
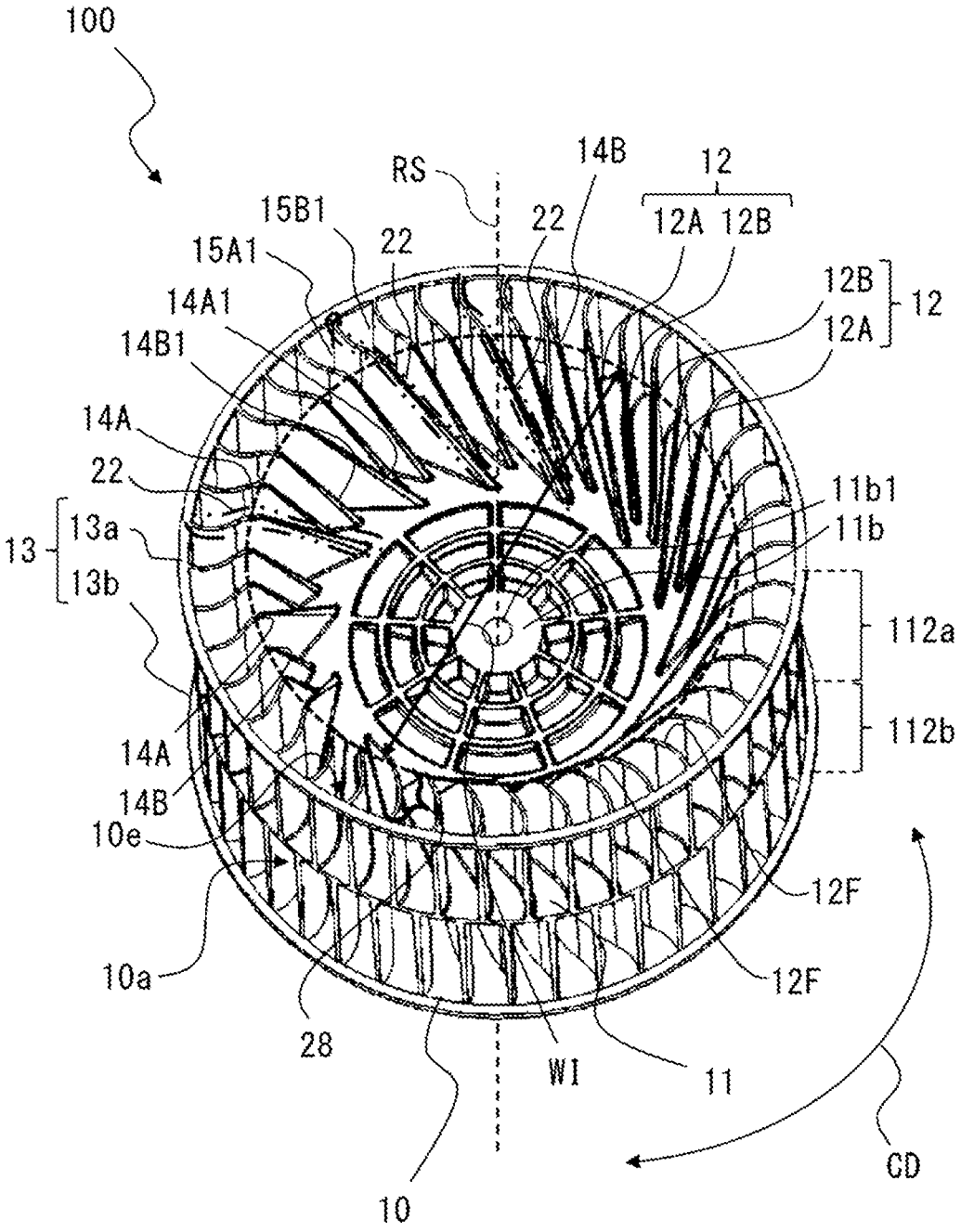
FIG. 4 is a perspective view that illustrates an impeller included in the centrifugal air-sending device according to Embodiment 1.
Figure 5:
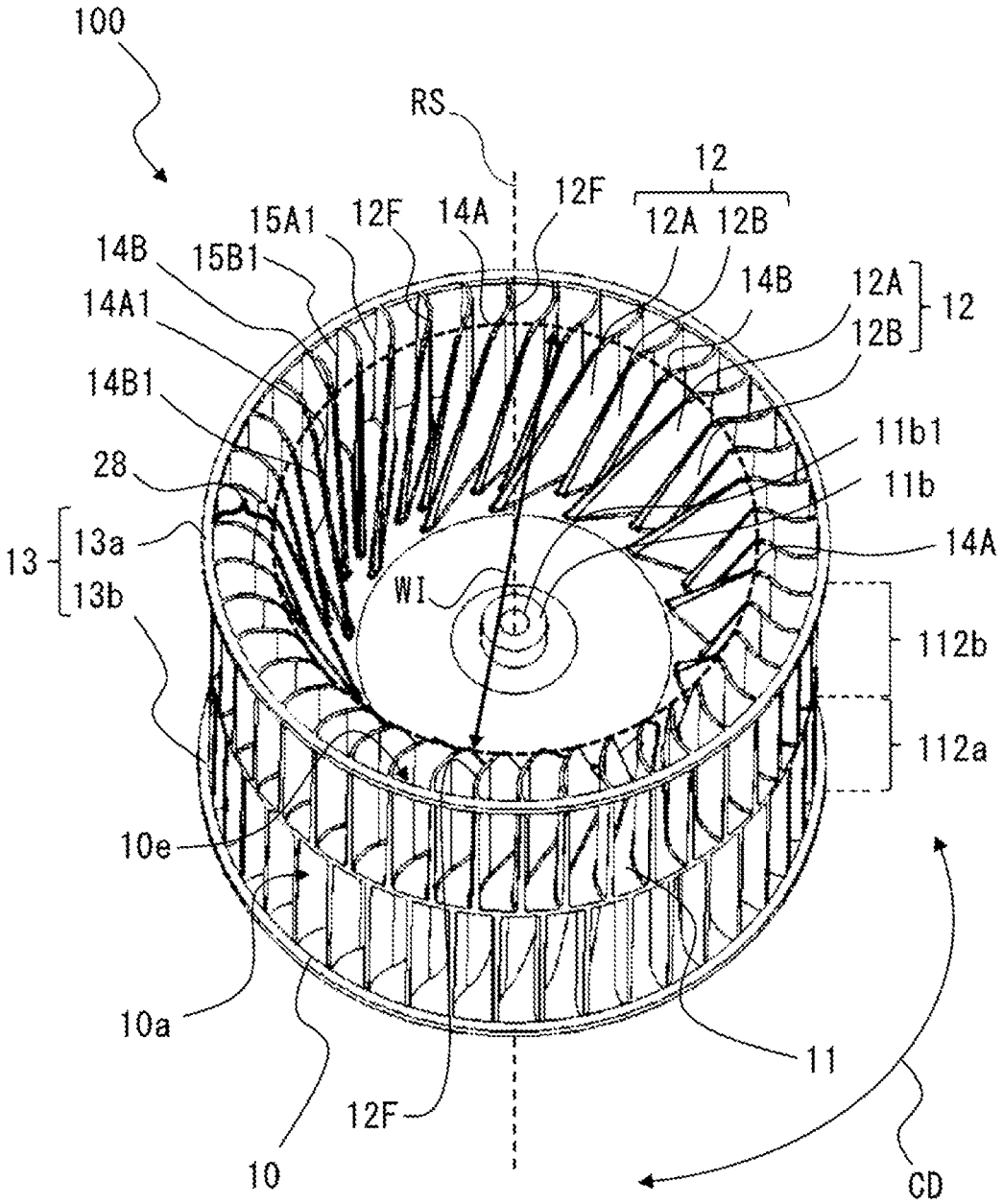
FIG. 5 is a perspective view that illustrates the impeller illustrated in FIG. 4 with the impeller viewed opposite to the perspective view illustrated in FIG. 4.
Figure 6:
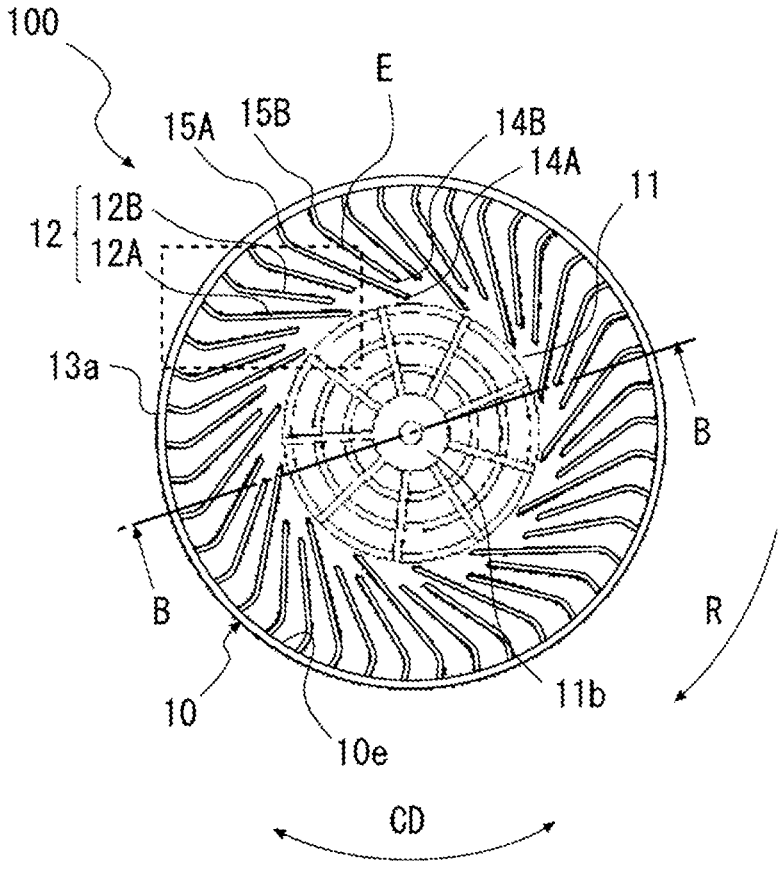
FIG. 6 is a plan view that illustrates the impeller included in the centrifugal air-sending device according to Embodiment 1 with the impeller viewed toward one face of the main plate.
Figure 7:
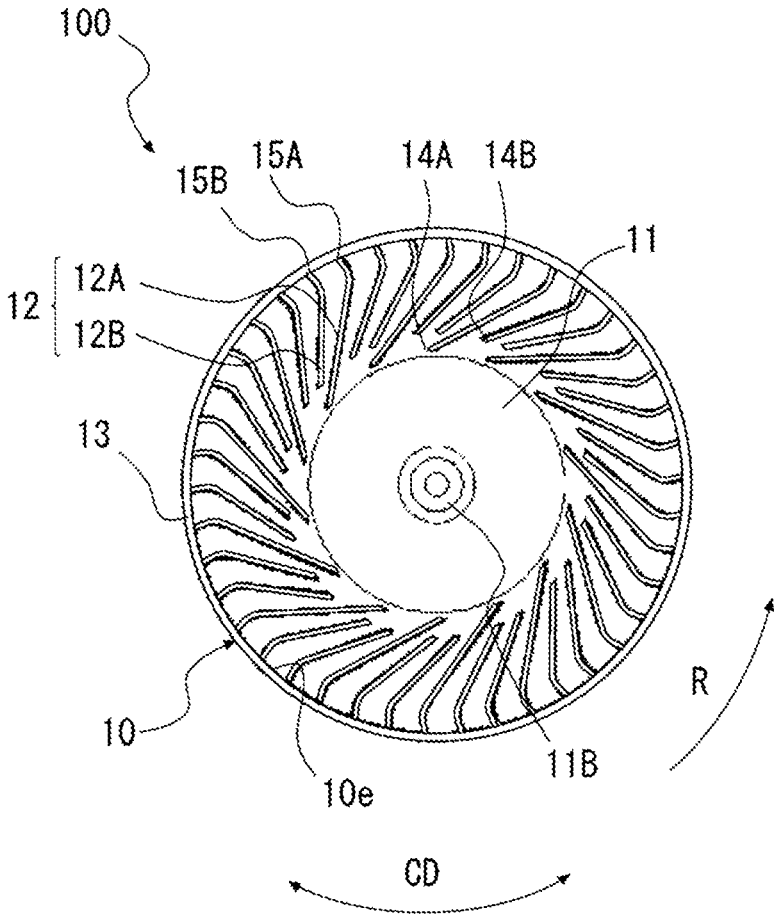
FIG. 7 is a plan view that illustrates the impeller included in the centrifugal air-sending device according to Embodiment 1 with the impeller viewed toward the other face of the main plate.
Figure 8:
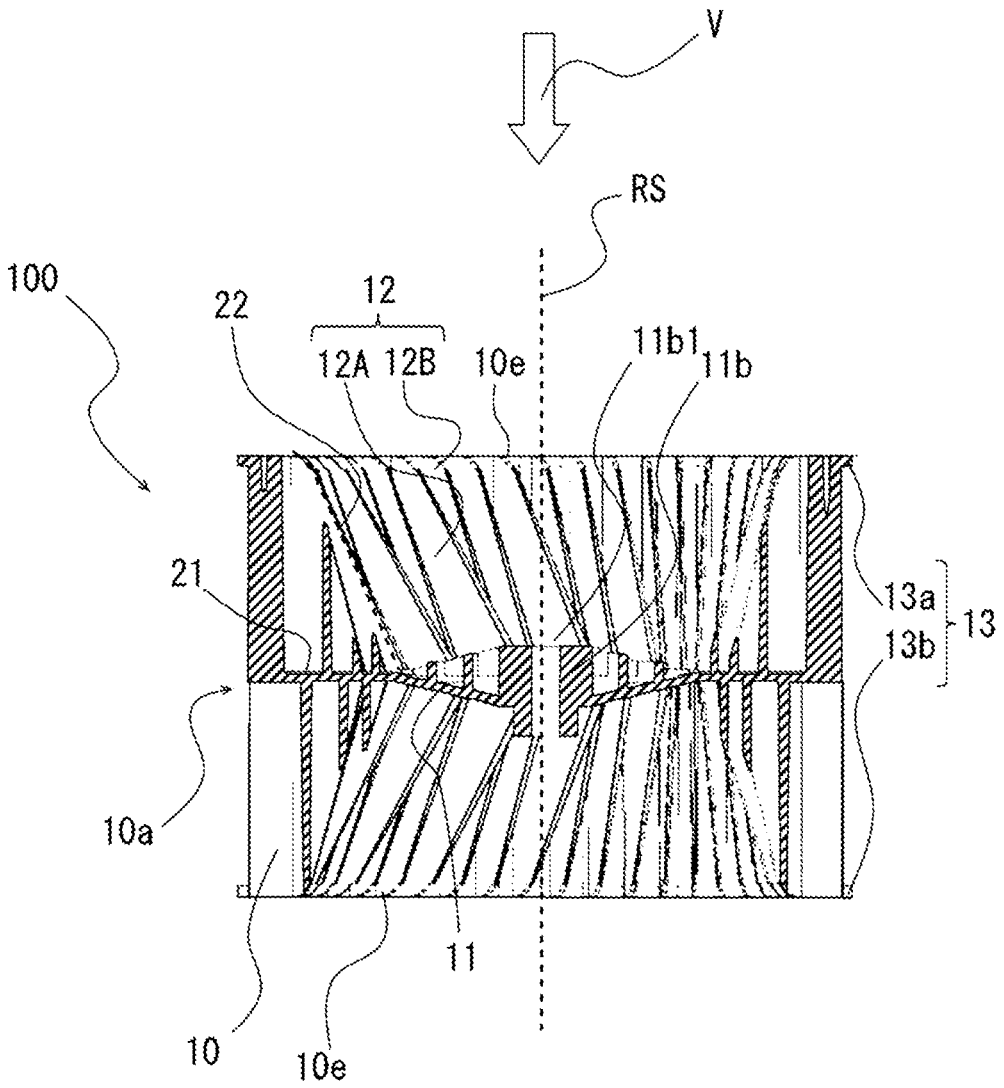
FIG. 8 is a sectional view that illustrates the impeller illustrated in FIG. 6 taken along line B-B.

FIG. 4 is a perspective view that illustrates the impeller 10 included in the centrifugal air-sending device 100 according to Embodiment 1. FIG. 5 is a perspective view that illustrates the impeller 10 illustrated in FIG. 4 with the impeller 10 viewed opposite to the perspective view illustrated in FIG. 4. FIG. 6 is a plan view that illustrates the impeller 10 included in the centrifugal air-sending device 100 according to Embodiment 1 with the impeller 10 viewed toward one face of the main plate 11. FIG. 7 is a plan view that illustrates the impeller 10 included in the centrifugal air-sending device 100 according to Embodiment 1 with the impeller 10 viewed toward the other face of the main plate 11. FIG. 8 is a sectional view that illustrates the impeller 10 illustrated in FIG. 6 taken along line B-B. The impeller 10 is described below with reference to FIG. 4 to FIG. 8.

The impeller 10 is a centrifugal fan. The impeller 10 is connected to an unillustrated motor that has a drive shaft. The impeller 10 is driven by the motor into rotation. The rotation generates a centrifugal force with which the impeller 10 forcibly sends out air outward in the radial directions. The impeller 10 is driven by the motor or other drive source to rotate in the rotation direction R, which is illustrated by an arrow. As illustrated in FIG. 4, the impeller 10 has the main plate 11, which is disk-shaped, side plates 13, which are each ring-shaped, and the plurality of blades 12 arranged on a circumferential edge portion of the main plate 11 and arranged radially around the rotation axis RS as their center.

Main Plate 11

The main plate 11 is only required to be plate-shaped and may also be formed in a polygonal shape or other shape other than such a disk shape. The main plate 11 may also be formed such that the thickness of the main plate 11 increases toward the center of the main plate 11 in the radial direction centered on the rotation axis RS as illustrated in FIG. 3. Alternatively, the main plate 11 may also be formed such that the thickness of the main plate 11 is constant in the radial direction centered on the rotation axis RS. In addition, the main plate 11 is not limited to one plate component. The main plate 11 may also be a plurality of plate components that are integrally fixed to each other.

The boss portion 11*b*, to which the drive shaft of the motor is connected, is located at the center portion of the main plate 11. In the boss portion 11*b*, a shaft hole 11*b*1 is opened. To the shaft hole 11*b*1, the drive shaft of the motor is inserted. The boss portion 11*b* is described to be circular-cylindrical-shaped. The boss portion 11*b* is, however, not limited to such a circular cylindrical shape. The boss portion 11*b* is only required to be pillar-shaped. The boss portion 11*b* may also be, for example, polygonal-pillar-shaped. The main plate 11 is driven to rotate by the motor by use of the boss portion 11*b*.

Side Plates 13

The impeller 10 has side plates 13, which are each ring-shaped, are each attached to the corresponding end portions of the plurality of blades 12 that are opposite to the main plate 11 in the axial direction of the rotation axis RS of the boss portion 11*b*. The side plates 13 are located at an outer circumferential side face 10*a* of the impeller 10. In the impeller 10, the side plates 13 each face the main plate 11. The side plates 13 are located outside the blades 12 in the radial directions centered on the rotation axis RS. The side plates 13 define the respective air inlets 10*e* of the impeller 10. The side plates 13 each connect the plurality of blades 12 with each other and thus maintain a positional relationship between tips of the blades 12 and reinforce the plurality of blades 12.

The side plates 13 includes the first side plate 13*a*, which is ring-shaped and faces the main plate 11, and the second side plate 13*b*, which is ring-shaped and faces the main plate 11 at a position opposite to a position at which the first side plate 13*a* is located. The first side plate 13*a* and the second side plate 13*b* are collectively referred to as the side plates 13. The impeller 10 has the first side plate 13*a*, which is spaced from one face of the main plate 11, and the second side plate 13*b*, which is spaced from the other face of the main plate 11, in the axial direction of the rotation axis RS.

Blades 12

As illustrated in FIG. 4, the plurality of blades 12 each have one edge connected to the main plate 11 and the other edge connected to the corresponding one of the side plates 13. The plurality of blades 12 are arranged in a circumferential direction CD centered on the rotation axis RS, which is virtual, of the main plate 11. The plurality of blades 12 are each located between the main plate 11 and the corresponding one of the side plates 13. The plurality of blades 12 are located at both respective faces of the main plate 11 in the axial direction of the rotation axis RS of the boss portion 11*b*. Each of the blades 12 is regularly spaced from another one of the blades 12 on the circumferential edge portion of the main plate 11.

Figure 9:
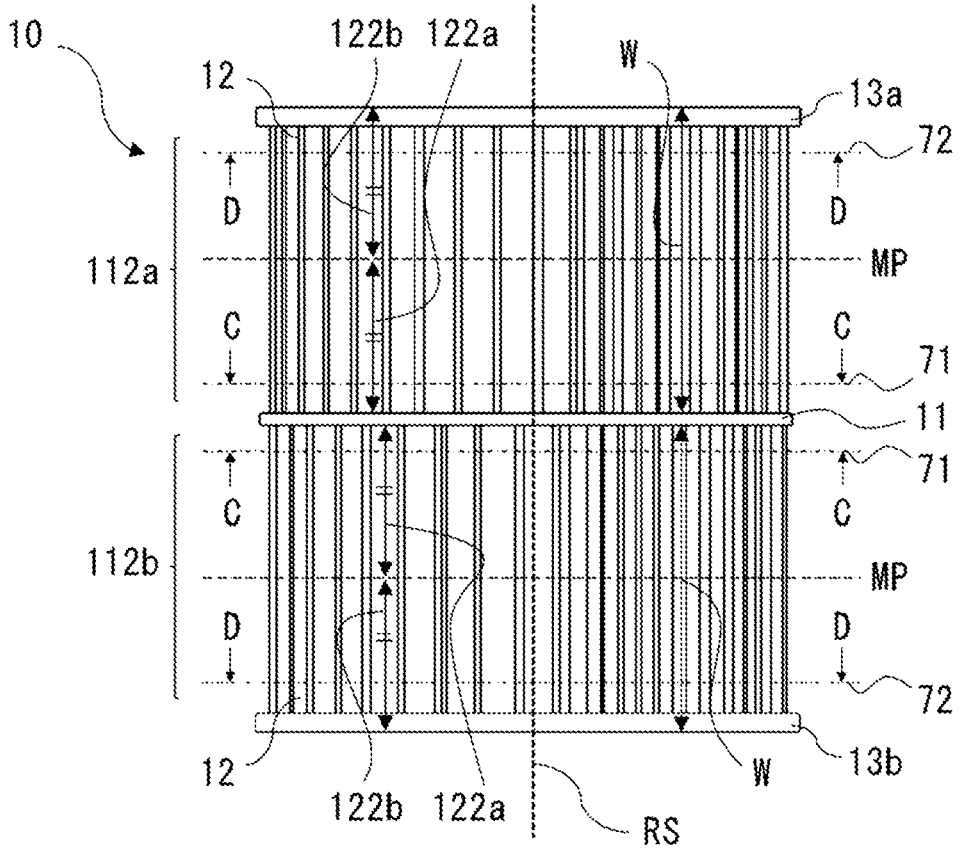
FIG. 9 is a side view that illustrates the impeller illustrated in FIG. 4.

FIG. 9 is a side view that illustrates the impeller 10 illustrated in FIG. 4. As illustrated in FIG. 4 and FIG. 9, the impeller 10 has a first vane portion 112*a* and a second vane portion 112*b*. The first vane portion 112*a* and the second vane portion 112*b* are each formed by the corresponding ones of the plurality of blades 12 and the corresponding one of the side plates 13. More specifically, the first vane portion 112*a* is formed by the first side plate 13*a*, which is ring-shaped, and ones of the plurality of blades 12 that are located between the main plate 11 and the first side plate 13*a*. The second vane portion 112*b* is formed by the second side plate 13*b*, which is ring-shaped, and ones of the plurality of blades 12 that are located between the main plate 11 and the second side plate 13*b*.

The first vane portion 112*a* is located at one plate surface of the main plate 11 and the second vane portion 112*b* is located at the other plate surface of the main plate 11. In other words, sets of the plurality of blades 12 are located at both respective faces of the main plate 11 in the axial direction of the rotation axis RS. The first vane portion 112*a* and the second vane portion 112*b* are located opposite to each other across the main plate 11. In FIG. 3, the first vane portion 112*a* is located at the left face of the main plate 11 and the second vane portion 112*b* is located at the right face of the main plate 11. The first vane portion 112*a* and the second vane portion 112*b* are, however, only required to be located opposite to each other across the main plate 11. The first vane portion 112*a* may also be located at the right face of the main plate 11 and the second vane portion 112*b* may also be located at the left face of the main plate 11. In description below, unless otherwise noted, the blades 12 included in the first vane portion 112*a* and the blades 12 included in the second vane portion 112*b* are collectively referred to as the blades 12.

As illustrated in FIG. 4 and FIG. 5, the impeller 10 is formed in a tube shape by the plurality of blades 12 located at the main plate 11. Furthermore, the impeller 10 has the air inlets 10*e*, through which gas flows into a space defined by the main plate 11 and the plurality of blades 12. The air inlets 10*e* are located at the respective side plates 13, which are opposite to the main plate 11 in the axial direction of the rotation axis RS of the boss portion 11*b*. The impeller 10 has the blades 12 and the side plates 13 at both respective faces of the plate surfaces of the main plate 11. The air inlets 10*e* of the impeller 10 are formed at both respective faces of the plate surfaces of the main plate 11.

When the unillustrated motor drives the impeller 10, the impeller 10 rotates about the rotation axis RS as its center. When the impeller 10 rotates, gas outside the centrifugal air-sending device 100 passes through the suction ports 45 formed in the scroll casing 40 and the air inlets 10*e* of the impeller 10, which are illustrated in FIG. 1, and is sucked into the space defined by the main plate 11 and the plurality of blades 12. When the impeller 10 rotates, air sucked into the space defined by the main plate 11 and the plurality of blades 12 then passes through a space between ones of the blades 12 that are next to each other and is sent outward in the radial directions of the impeller 10.

Details of Configuration of Blades 12

Figure 10:
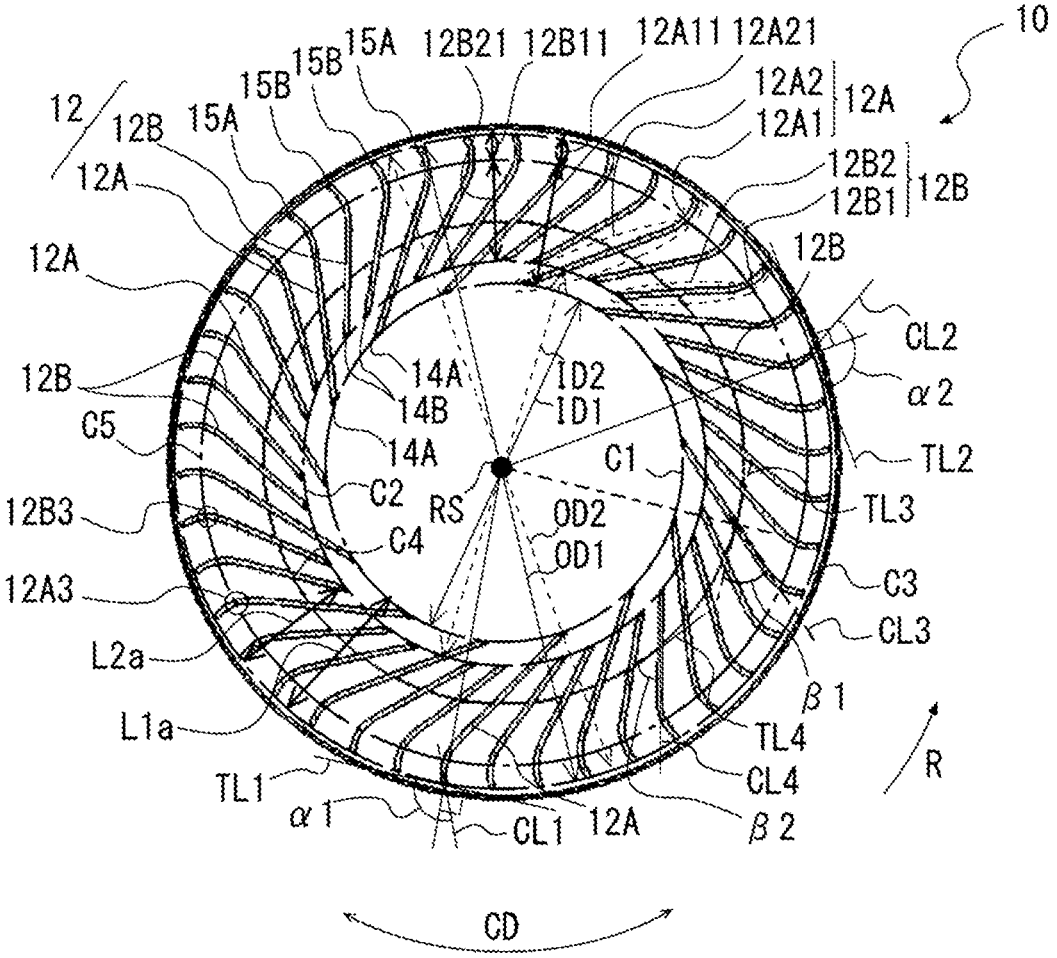
FIG. 10 is a schematic view that illustrates a section of blades included in the impeller illustrated in FIG. 9 taken along line C-C.
Figure 11:
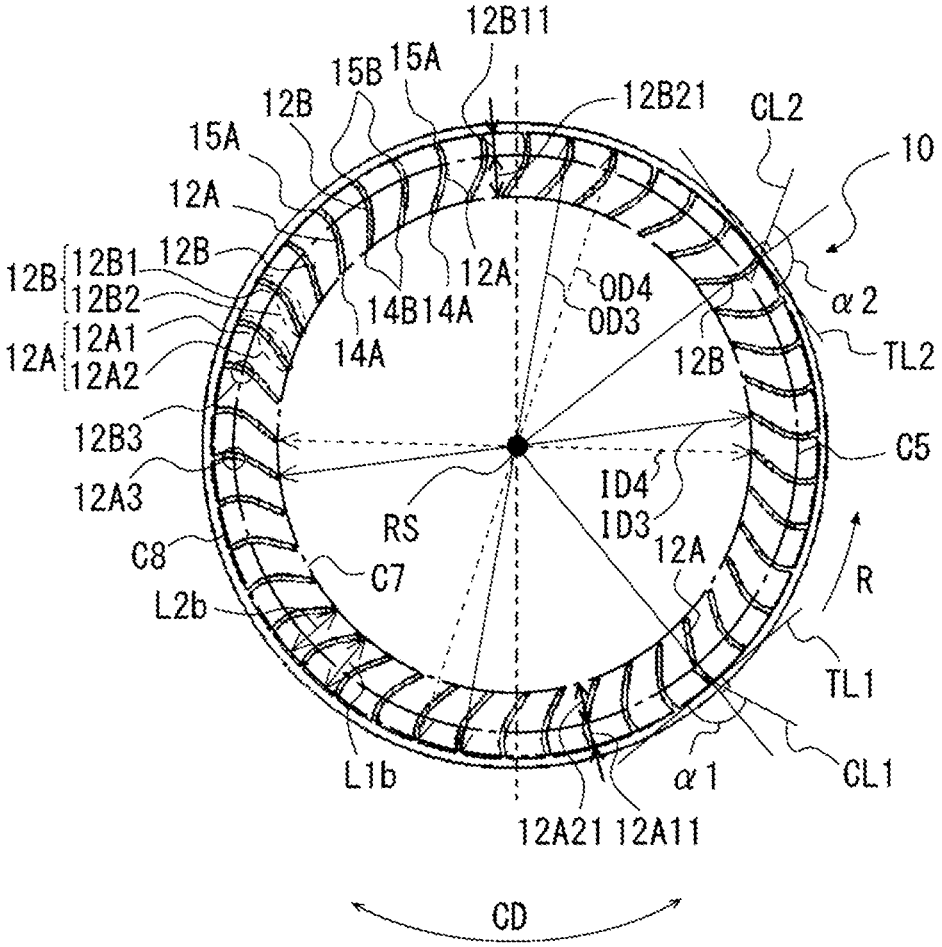
FIG. 11 is a schematic view that illustrates a section of the blades included in the impeller illustrated in FIG. 9 taken along line D-D.

FIG. 10 is a schematic view that illustrates the blades 12 included in the impeller 10 illustrated in FIG. 9 with the blades 12 viewed in a section taken along line C-C. FIG. 11 is a schematic view that illustrates the blades 12 included in the impeller 10 illustrated in FIG. 9 with the blades 12 viewed in a section taken along line D-D. An intermediate position MP in the impeller 10 illustrated in FIG. 9 is an intermediate position of the plurality of blades 12 included in the first vane portion 112*a* in the axial direction of the rotation axis RS. Another intermediate position MP in the impeller 10 illustrated in FIG. 9 is an intermediate position between the main plate 11 and the corresponding one of the side plates 13 in the plurality of blades 12 included in the second vane portion 112*b* in the axial direction of the rotation axis RS.

In the plurality of blades 12 included in the first vane portion 112*a*, a range from the intermediate position MP to the main plate 11 in the axial direction of the rotation axis RS is defined as a main-plate-side blade region 122*a*, which is a first region in the impeller 10. In the plurality of blades 12 included in the first vane portion 112*a*, a range from the intermediate position MP to the corresponding one of the side plates 13 in the axial direction of the rotation axis RS is defined as a side-plate-side blade region 122*b*, which is a second region in the impeller 10. In other words, in the axial direction of the rotation axis RS, the plurality of blades 12 have the first region, which is located closer to the main plate 11 than is the intermediate position MP, and the second region, which is located closer to the corresponding one of the side plates 13 than is the first region.

The section taken along line C-C illustrated in FIG. 9 is, as illustrated in FIG. 10, a section of the plurality of blades 12 that are located close to the main plate 11 of the impeller 10, that is, at the main-plate-side blade region 122*a*, which is the first region. The section of the blades 12 close to the main plate 11 is a first flat surface 71, which is perpendicular to the rotation axis RS, and is a first section of the impeller 10, which is obtained by cutting a portion of the impeller 10 cl-ose to the main plate 11. The portion of the impeller 10 close to the main plate 11 is a portion in the main-plate-side blade region 122*a* that is closer to the main plate 11 than is the intermediate position of the main-plate-side blade region 122*a* in the axial direction of the rotation axis RS or is a portion at which end portions of the blades 12 closest to the main plate 11 in the axial direction of the rotation axis RS is located.

The section taken along line D-D illustrated in FIG. 9 is, as illustrated in FIG. 11, a section of the plurality of blades 12 that are located close to the corresponding one of the side plates 13 of the impeller 10, that is, at a side-plate-side blade region 122*b*, which is the second region. The section of the blades 12 close to the corresponding one of the side plates 13 is a second flat surface 72, which is perpendicular to the rotation axis RS, and is a second face of the impeller 10, which is obtained by cutting a portion of the impeller 10 close to the corresponding one of the side plates 13. The portion of the impeller 10 close to the corresponding one of the side plates 13 is a portion in the side-plate-side blade region 122*b* that is closer to the corresponding one of the side plates 13 than is the intermediate position of the side-plate-side blade region 122*b* in the axial direction of the rotation axis RS or is a portion at which end portions of the blades 12 closest to the corresponding one of the side plates 13 in the axial direction of the rotation axis RS is located.

The basic configuration of the blades 12 included in the second vane portion 112*b* is similar to the basic configuration of the blades 12 included in the first vane portion 112*a*. In other words, in the plurality of blades 12 included in the second vane portion 112*b*, a range from the intermediate position MP to the main plate 11 in the axial direction of the rotation axis RS is defined as the main-plate-side blade region 122*a*, which is the first region in the impeller 10. In the plurality of blades 12 included in the second vane portion 112*b*, a range from the intermediate position MP to the second side plate 13*b* in the axial direction of the rotation axis RS is also defined as the side-plate-side blade region 122*b*, which is a second region in the impeller 10.

The basic configuration of the first vane portion 112*a* and the basic configuration of the second vane portion 112*b* are described above to be similar to each other. The configuration of the impeller 10 is, however, not limited to the configuration described above and the first vane portion 112*a* and the second vane portion 112*b* may also have different configurations. The configuration of the blades 12 described below may also include both or either one of the first vane portion 112*a* and the second vane portion 112*b*.

As illustrated in FIG. 9 to FIG. 11, the plurality of blades 12 include a plurality of first blades 12A and a plurality of second blades 12B. In the plurality of blades 12, the first blades 12A and the second blades 12B are alternately arranged in the circumferential direction CD of the impeller 10 such that one or a plurality of second blades 12B are located between the first blades 12A.

As illustrated in FIG. 9 to FIG. 11, in the impeller 10, two of the second blades 12B are located between one of the first blades 12A and another one of the first blades 12A that is located next to the one of the first blades 12A in the rotation direction R. The number of the second blades 12B located between one of the first blades 12A and another one of the first blades 12A that is located next to the one of the first blades 12A in the rotation direction R is not limited to two and may also be one or three or more. In other words, at least one second blade 12B of the plurality of second blades 12B is located between two of the plurality of first blades 12A that are next to each other in the circumferential direction CD.

As illustrated in FIG. 10, in the first section of the impeller 10, which is obtained by cutting portions with the first flat surface 71, which is perpendicular to the rotation axis RS, the first blades 12A each have an inner circumferential end 14A and an outer circumferential end 15A. The inner circumferential ends 14A are located closest to the rotation axis RS in the radial directions centered on the rotation axis RS. The outer circumferential ends 15A are located closer to an outer circumference than are the inner circumferential ends 14A in the radial directions. In each of the first blades 12A, the inner circumferential end 14A is further forward than is the outer circumferential end 15A in the rotation direction R of the impeller 10.

As illustrated in FIG. 4, the inner circumferential ends 14A are each a leading edge 14A1 of the first blade 12A and the outer circumferential ends 15A are each a trailing edge 15A1 of the first blade 12A. As illustrated in FIG. 11, the impeller 10 has the 14 first blades 12A. The number of the first blades 12A is, however, not limited to 14 and may also be less than 14 or more than 14.

As illustrated in FIG. 10, in the first section of the impeller 10, which is obtained by cutting portions with the first flat surface 71, which is perpendicular to the rotation axis RS, the second blades 12B each have an inner circumferential end 14B and an outer circumferential end 15B. The inner circumferential ends 14B are located closest to the rotation axis RS in the radial directions centered on the rotation axis RS. The outer circumferential ends 15B are located closer to the outer circumference than are the inner circumferential ends 14B in the radial directions. In each of the second blades 12B, the inner circumferential end 14B is further forward than is the outer circumferential end 15B in the rotation direction R of the impeller 10.

As illustrated in FIG. 4, the inner circumferential ends 14B are each a leading edge 14B1 of the second blade 12B and the outer circumferential ends 15B are each a trailing edge 15B1 of the second blade 12B. As illustrated in FIG. 10, the impeller 10 has the 28 second blades 12B. The number of the second blades 12B is, however, not limited to 28 and may also be less than 28 or more than 28.

Next, the relationship of each of the first blades 12A and the corresponding one of the second blades 12B is described below. As illustrated in FIG. 4 and FIG. 11, a vane length of the first blade 12A is designed to be more closely equal to a vane length of the second blade 12B as the first blade 12A is closer to the corresponding one of the first side plate 13*a* and the second side plate 13*b* than the intermediate position MP in a direction along the rotation axis RS.

On the other hand, as illustrated in FIG. 4 and FIG. 10, the vane length of the first blade 12A is designed to be greater than the vane length of the second blade 12B at a location at which the first blade 12A is closer to the main plate 11 than the intermediate position MP in the direction along the rotation axis RS. In addition, the vane length of the first blade 12A is designed to be increased as the first blade 12A is closer to the main plate 11 in the direction along the rotation axis RS. As described above, in Embodiment 1, the vane length of the first blade 12A is designed to be greater than the vane length of the second blade 12B at a least some location in the rotation axis RS. The vane length described here refers to the length of the first blade 12A in a radial direction of the impeller 10 or the length of the second blade 12B in a radial direction of the impeller 10.

In the first section, which is illustrated in FIG. 9 and is closer to the main plate 11 than the intermediate position MP, as illustrated in FIG. 10, the diameter of a circle C1, which passes the inner circumferential ends 14A of the plurality of first blades 12A around the rotation axis RS as its center, that is, the inner diameter of the first blades 12A is referred to as an inner diameter ID1. The diameter of a circle C3, which passes the outer circumferential ends 15A of the plurality of first blades 12A around the rotation axis RS as its center, that is, the outer diameter of the first blades 12A is referred to as an outer diameter OD1. Half of a difference between the outer diameter OD1 and the inner diameter ID1 is defined as a vane length L1*a* of the first blade 12A in the first section (vane length L1*a*=(outer diameter OD1−inner diameter ID1)/2).

Here, the ratio of the inner diameter of the first blade 12A to the outer diameter of the first blade 12A is lower than or equal to 0.7. In other words, the plurality of first blades 12A have a ratio of lower than or equal to 0.7 of the inner diameter ID1 of the respective inner circumferential ends 14A of the plurality of first blades 12A to the outer diameter OD1 of the respective outer circumferential ends 15A of the plurality of first blade 12A.

In a typical centrifugal air-sending device, a vane length of a blade in a section perpendicular to a rotation axis is shorter than a width dimension of the blade in a direction of the rotation axis. In Embodiment 1, the maximum possible vane length of the first blade 12A, that is, the vane length of the first blade 12A close to the main plate 11 is designed to be shorter than a width dimension W (refer to FIG. 9) in a direction of the rotation axis of the first blade 12A.

In the first section, the diameter of a circle C2, which passes the inner circumferential ends 14B of the plurality of second blades 12B around the rotation axis RS as its center, that is, the inner diameter of the second blades 12B, is referred to as an inner diameter ID2, which is larger than the inner diameter ID1 (inner diameter ID2>inner diameter ID1). The diameter of a circle C3, which passes the outer circumferential ends 15B of the plurality of second blades 12B around the rotation axis RS as its center, that is, the outer diameter of the second blades 12B is referred to as an outer diameter OD2, which is equal to the outer diameter OD1 (outer diameter OD2=outer diameter OD1). Half of a difference between the outer diameter OD2 and the inner diameter ID2 is defined as a vane length L2*a* of the second blade 12B in the first section (vane length L2*a*=(outer diameter OD2−inner diameter ID2)/2). The vane length L2*a* of the second blade 12B in the first section is shorter than the vane length L1*a* of the first blade 12A in the first section (vane length L2*a*<vane length L1*a*).

Here, the ratio of the inner diameter of the second blade 12B to the outer diameter of the second blade 12B is lower than or equal to 0.7. In other words, the plurality of second blades 12B have a ratio of lower than or equal to 0.7 of the inner diameter ID2 of the respective inner circumferential ends 14B of the plurality of second blades 12B to the outer diameter OD2 of the respective outer circumferential ends 15B of the plurality of second blades 12B.

On the other hand, in the second section, which is illustrated in FIG. 9 and is closer to the corresponding one of the side plates 13 than the intermediate position MP, as illustrated in FIG. 11, the diameter of a circle C7, which passes the inner circumferential ends 14A of the plurality of first blades 12A around the rotation axis RS as its center is referred to as an inner diameter ID3. The inner diameter ID3 is larger than the inner diameter ID1 in the first section (inner diameter ID3>inner diameter ID1). The diameter of a circle C8, which passes the outer circumferential ends 15A of the first blades 12A around the rotation axis RS as its center is referred to as an outer diameter OD3. Half of a difference between the outer diameter OD3 and the inner diameter ID1 is defined as a vane length L1*b* of the first blade 12A in the second section (vane length L1*b*=(outer diameter OD3−inner diameter ID3)/2).

In the second section, the diameter of a circle C7, which passes the inner circumferential ends 14B of the second blades 12B around the rotation axis RS as its center is referred to as an inner diameter ID4. The inner diameter ID4 is equal to the inner diameter ID3 in the second section (inner diameter ID4>inner diameter ID3). The diameter of a circle C8, which passes the outer circumferential ends 15B of the second blades 12B around the rotation axis RS as its center is referred to as an outer diameter OD4. The outer diameter OD4 is equal to the outer diameter OD3 in the second section (outer diameter O4=outer diameter OD3). Half of a difference between the outer diameter OD4 and the inner diameter ID4 is defined as a vane length L2*b* of the second blade 12B in the second section (vane length L2*b*=(outer diameter OD4−inner diameter ID4)/2). The vane length L2*b* of the second blade 12B in the second section is equal to the vane length LIb of the first blade 12A in the second section (vane length L2*b*=vane length L1*b*).

When the first blade 12A is viewed parallel to the rotation axis RS, the first blade 12A in the second section illustrated in FIG. 11 overlaps the first blade 12A in the first section illustrated in FIG. 10 such that the first blade 12A in the second section does not protrude out from the outline of the first blade 12A in the first section. The impeller 10 is thus designed to satisfy relationships of outer diameter OD3=outer diameter OD1, inner diameter ID3≥inner diameter ID1, and vane length L1*b*≤vane length L1*a*.

Similarly, when the second blade 12B is viewed parallel to the rotation axis RS, the second blade 12B in the second section illustrated in FIG. 11 overlaps the second blade 12B in the first section illustrated in FIG. 10 such that the second blade 12B in the second section does not protrude out from the outline of the second blade 12B in the first section. The impeller 10 is thus designed to satisfy relationships of outer diameter OD4=outer diameter OD2, inner diameter ID4≥inner diameter ID2, and vane length L2*b* s vane length L2*a*.

Here, as described above, the ratio of the inner diameter ID1 of the first blades 12A to the outer diameter OD1 of the first blades 12A is lower than or equal to 0.7. Since the blade 12 is designed to satisfy relationships of inner diameter ID3≥inner diameter ID1, inner diameter ID4≥inner diameter ID2, inner diameter ID2>inner diameter ID1, the inner diameter of the first blades 12A is defined as a blade inner diameter of the blades 12. Since the blade 12 is designed to satisfy relationships of outer diameter OD3=outer diameter OD1, outer diameter OD4=outer diameter OD2, outer diameter OD2=outer diameter OD1, the outer diameter of the first blades 12A is also defined as a blade outer diameter of the blades 12. When the blades 12 included in the impeller 10 is viewed as a whole, a ratio of the inner diameter of the blades 12 to the outer diameter of the blades 12 is lower than or equal to 0.7.

The blade inner diameter of the plurality of blades 12 is a diameter of the respective inner circumferential ends of the plurality of blades 12. In other words, the blade inner diameter of the plurality of blades 12 is a diameter of the leading edges 14A1 of the plurality of blades 12. The blade outer diameter of the plurality of blades 12 is also a diameter of the respective outer circumferential ends of the plurality of blades 12. In other words, the blade outer diameter of the plurality of blades 12 is a diameter of the trailing edges 15A1 and the trailing edges 15B1 of the plurality of blades 12.

Configurations of First Blades 12A and Second Blades 12B

The first blade 12A has a relationship of vane length L1*a*>vane length L1*b* in comparison between the first section illustrated in FIG. 10 and the second section illustrated in FIG. 11. In other words, the plurality of blades 12 each have a portion at which the vane length in the first region is formed greater than the vane length in the second region. More specifically, the first blade 12A has a portion at which the vane length of the first blade 12A decreases from the main plate 11 to the corresponding one of the side plates 13 in the axial direction of the rotation axis RS.

Similarly, the second blade 12B has a relationship of vane length L2*a*>vane length L2*b* in comparison between the first section illustrated in FIG. 10 and the second section illustrated in FIG. 11. In other words, the second blade 12B has a portion at which the vane length of the second blade 12B decreases from the main plate 11 to the corresponding one of the side plates 13 in the axial direction of the rotation axis RS.

As illustrated in FIG. 3, the leading edges of the first blades 12A and the second blades 12B are inclined such that the blade inner diameter increases from the main plate 11 to the corresponding one of the side plates 13. In other words, the plurality of blades 12 are formed such that the blade inner diameter is increased from the main plate 11 to the corresponding one of the side plates 13 and have inclination portions 141A, which are each inclined such that the inner circumferential ends 14A included in the leading edges 14A1 are away from the rotation axis RS. Similarly, the plurality of blades 12 are formed such that the blade inner diameter is increased from the main plate 11 to the corresponding one of the side plates 13 and have inclination portions 141B, which are each inclined such that the inner circumferential ends 14B included in the leading edges 14B1 are away from the rotation axis RS.

Sirocco Vane Portion and Turbo Vane Portion

As illustrated in FIG. 10 and FIG. 11, the first blades 12A each have a first sirocco vane portion 12A1, which includes the outer circumferential end 15A and is formed as a forward-curved blade, and a first turbo vane portion 12A2, which includes the inner circumferential end 14A and is formed as a backward-curved blade. In a radial direction of the impeller 10, the first sirocco vane portion 12A1 forms a portion of the first blade 12A that is closer to the outer circumference than is the first turbo vane portion 12A2, which forms a portion of the first blade 12A that is closer to an inner circumference than is the first sirocco vane portion 12A1. In other words, the first blade 12A is formed such that the first turbo vane portion 12A2 and the first sirocco vane portion 12A1 are arranged sequentially from the rotation axis RS toward the outer circumference in the radial direction of the impeller 10.

In the first blade 12A, the first turbo vane portion 12A2 and the first sirocco vane portion 12A1 are integrally formed with each other. The first turbo vane portion 12A2 forms the leading edge 14A1 of the first blade 12A and the first sirocco vane portion 12A1 forms the trailing edge 15A1 of the first blade 12A. The first turbo vane portion 12A2 linearly extends from the inner circumferential end 14A included in the leading edge 14A1 toward the outer circumference in a radial direction of the impeller 10.

In a radial direction of the impeller 10, a region of the first blade 12A in which the first sirocco vane portion 12A1 is located is defined as a first sirocco region 12A11 and a region of the first blade 12A in which the first turbo vane portion 12A2 is located is defined as a first turbo region 12A21. The first blade 12A is formed such that the first turbo region 12A21 is larger than the first sirocco region 12A11 in a radial direction of the impeller 10.

In the main-plate-side blade region 122*a*, which is the first region, and the side-plate-side blade region 122*b*, which is the second region, illustrated in FIG. 9, the impeller 10 has a relationship of first sirocco region 12A11<first turbo region 12A21 in a radial direction of the impeller 10. In the main-plate-side blade region 122*a*, which is the first region, and the side-plate-side blade region 122*b*, which is the second region, in the impeller 10 and the first blades 12A, a proportion for which the first turbo vane portion 12A2 accounts is higher in a radial direction of the impeller 10 than a proportion for which the first sirocco vane portion 12A1 accounts.

Similarly, as illustrated in FIG. 10 and FIG. 11, the second blade 12B each have a second sirocco vane portion 12B1, which includes the outer circumferential end 15B and is formed as a forward-curved blade, and a second turbo vane portion 12B2, which includes the inner circumferential end 14B and is formed as a backward-curved blade. In a radial direction of the impeller 10, the second sirocco vane portion 12B1 forms a portion of the second blade 12B that is closer to the outer circumference than is the second turbo vane portion 12B2, which forms a portion of the second blade 12B that is closer to the inner circumference than is the second sirocco vane portion 12B1. In other words, the second blade 12B is formed such that the second turbo vane portion 12B2 and the second sirocco vane portion 12B1 are arranged sequentially from the rotation axis RS toward the outer circumference in the radial direction of the impeller 10.

In the second blade 12B, the second turbo vane portion 12B2 and the second sirocco vane portion 12B1 are integrally formed with each other. The second turbo vane portion 12B2 forms the leading edge 14B1 of the second blade 12B and the second sirocco vane portion 12B1 forms the trailing edge 15B1 of the of the second blade 12B. The second turbo vane portion 12B2 linearly extends from the inner circumferential end 14B included in the leading edge 14B1 toward the outer circumference in a radial direction of the impeller 10.

In a radial direction of the impeller 10, a region of the second blade 12B in which the second sirocco vane portion 12B1 is located is defined as a second sirocco region 12B11 and a region of the second blade 12B in which the second turbo vane portion 12B2 is located is defined as a second turbo region 12B21. In the second blade 12B, the second turbo region 12B21 is larger than the second sirocco region 12B11 in a radial direction of the impeller 10.

In the main-plate-side blade region 122*a*, which is the first region, and the side-plate-side blade region 122*b*, which is the second region, illustrated in FIG. 9, the impeller 10 has a portion that has a relationship of second sirocco region 12B11<second turbo region 12B21 in a radial direction of the impeller 10. In the main-plate-side blade region 122*a*, which is the first region, and the side-plate-side blade region 122*b*, which is the second region, in the impeller 10 and the second blades 12B, a proportion for which the second turbo vane portion 12B2 accounts is higher in a radial direction of the impeller 10 than a proportion for which the second sirocco vane portion 12B1 accounts.

In the configuration described above, in the main-plate-side blade region 122*a* and the side-plate-side blade region 122*b* in the plurality of blades 12, a region in which a turbo vane portion is ranged is larger than a region in which a sirocco vane portion is ranged in a radial direction of the impeller 10. In other words, in the main-plate-side blade region 122*a* and the side-plate-side blade region 122*b*, the plurality of blades 12 have a portion in which a proportion for which a turbo vane portion accounts is higher in a radial direction of the impeller 10 than a proportion for which a sirocco vane portion accounts and thus has a portion that has a relation of sirocco portion<turbo portion. In other words, the plurality of blades 12 are each formed such that the proportion for which the turbo vane portion accounts is higher in the radial direction than the proportion for which the sirocco vane portion accounts in the first region and the second region. Such a relationship on the proportion for which the sirocco vane portion accounts and the proportion for which the turbo vane portion accounts in a radial direction from the rotation axis RS may also be satisfied through all regions of the main-plate-side blade region 122*a*, which is the first region, and the side-plate-side blade region 122*b*, which is the second region.

Through all regions of the main-plate-side blade region 122*a* and the side-plate-side blade region 122*b*, the plurality of blades 12 are not limited to the ones in which a proportion for which a turbo vane portion accounts is higher in a radial direction of the impeller 10 than a proportion for which a sirocco vane portion accounts and is not limited to have a relation of sirocco portion<turbo portion. The plurality of blades 12 may also be each formed such that the proportion for which the sirocco vane portion accounts is lower in the radial direction than or equal to the proportion for which the turbo vane portion accounts in the first region and the second region.

Outlet Angle

As illustrated in FIG. 10, an outlet angle at the first sirocco vane portion 12A1 included in the first blade 12A in the first section is defined as an outlet angle α1. The outlet angle α1 refers to an angle located at an intersection of a circular arc of the circle C3 centered on the rotation axis RS and the outer circumferential end 15A and formed between a tangent line TL1 of the circle and a center line CL1 of the first sirocco vane portion 12A1 at the outer circumferential end 15A. This outlet angle α1 is larger than 90 degrees.

An outlet angle at the second sirocco vane portion 12B1 included in the second blade 12B in the first section is defined as an outlet angle α2. The outlet angle α2 refers to an angle located at an intersection of a circular arc of the circle C3 centered on the rotation axis RS and the outer circumferential end 15B and formed between a tangent line TL2 of the circle and a center line CL2 of the second sirocco vane portion 12B1 at the outer circumferential end 15B. The outlet angle α2 is larger than 90 degrees.

The outlet angle α2 at the second sirocco vane portion 1211 is equal to the outlet angle α1 at the first sirocco vane portion 12A1 (outlet angle α2=outlet angle α1). When the first sirocco vane portion 12A1 and the second sirocco vane portion 12B1 are viewed parallel to the rotation axis RS, the first sirocco vane portion 12A1 and the second sirocco vane portion 12B1 are each arcuate and convex and protrude in a direction opposite to the rotation direction R.

As illustrated in FIG. 11, also in the second section of the impeller 10, the outlet angle α1 at the first sirocco vane portion 12A1 is equal to the outlet angle α2 at the second sirocco vane portion 12B1. In other words, the plurality of blades 12 each have the sirocco vane portion located from the main plate 11 and the corresponding one of the side plates 13 and formed as a forward-curved blade at which the outlet angle is formed larger than 90 degrees.

As illustrated in FIG. 10, an outlet angle at the first turbo vane portion 12A2 included in the first blade 12A in the first section is defined as an outlet angle β1. The outlet angle β1 refers to an angle located at an intersection of a circular arc of the circle C4 centered on the rotation axis RS and the first turbo vane portion 12A2 and formed between a tangent line TL3 of the circle and a center line CL3 of the first turbo vane portion 12A2. This outlet angle 131 is smaller than 90 degrees.

An outlet angle at the second turbo vane portion 12B2 included in the second blade 12B in the first section is defined as an outlet angle 12. The outlet angle 12 refers to an angle located at an intersection of a circular arc of the circle C4 centered on the rotation axis RS and the second turbo vane portion 12B2 and formed between a tangent line TL4 of the circle and a center line CL4 of the second turbo vane portion 12B2. The outlet angle β2 is smaller than 90 degrees.

The outlet angle β2 at the second turbo vane portion 12B2 is equal to the outlet angle β1 at the first turbo vane portion 12A2 (outlet angle β2=outlet angle β1).

An illustration is not provided in FIG. 11 that, also in the second section of the impeller 10, the outlet angle 11 at the first turbo vane portion 12A2 is equal to the outlet angle β2 at the second turbo vane portion 12B2. The outlet angle 11 and the outlet angle β2 are also each smaller than 90 degrees.

Radial Vane Portion

As illustrated in FIG. 10 and FIG. 11, the first blades 12A each have a first radial vane portion 12A3, which connects between the corresponding one of the first turbo vane portions 12A2 and the corresponding one of the first sirocco vane portions 12A1. The first radial vane portion 12A3 is formed as a radial vane that linearly extends in a radial direction of the impeller 10.

Similarly, the second blades 12B each have a second radial vane portion 12B3, which connects between the corresponding one of the second turbo vane portions 12B2 and the corresponding one of the second sirocco vane portions 12B1. The second radial vane portion 12B3 is formed as a radial vane that linearly extends in a radial direction of the impeller 10.

The vane angle of the first radial vane portion 12A3 and the vane angle of the second radial vane portion 12B3 are each 90 degrees. More specifically, an angle formed between a tangent line at an intersection of a center line of the first radial vane portion 12A3 and the circle C5 centered on the rotation axis RS and the center line of the first radial vane portion 12A3 is 90 degrees. An angle formed between a tangent line at an intersection of a center line of the second radial vane portion 12B3 and the circle C5 centered on the rotation axis RS and the center line of the second radial vane portion 12B3 is also 90 degrees.

Vane Interval

When the interval between two blades 12 of the plurality of blades 12 that are next to each other in the circumferential direction CD is defined as an vane interval, as illustrated in FIG. 10 and FIG. 11, the vane intervals of the plurality of blades 12 each expand from the corresponding one of the leading edges 14A1 toward the corresponding one of the trailing edges 15A1. Similarly, the vane intervals of the plurality of blades 12 each expand from the corresponding one of the leading edges 14B1 toward the corresponding one of the trailing edges 15B1.

Specifically, the vane intervals of the turbo vane portions, which include the first turbo vane portions 12A2 and the second turbo vane portions 12B2, each expand from the inner circumference to the outer circumference. In other words, the vane intervals of the turbo vane portions of the impeller 10 each expand from the inner circumference to the outer circumference. The vane intervals of the sirocco vane portions, which include the first sirocco vane portions 12A1 and the second sirocco vane portions 12B1, each are wider than the vane interval of the turbo vane portions and expand from the inner circumference to the outer circumference.

In other words, the vane interval between each of the first turbo vane portions 12A2 and the corresponding one of the second turbo vane portions 12B2 expands from the inner circumference to the outer circumference. The vane interval between any ones of the second turbo vane portions 12B2 that are next to each other also expands from the inner circumference to the outer circumference. The vane interval between each of the first sirocco vane portions 12A1 and the corresponding one of the second sirocco vane portions 12B1 is also wider than the vane interval of the turbo vane portions and expands from the inner circumference to the outer circumference. The vane interval between any ones of the second sirocco vane portions 12B1 that are next to each other is also wider than the vane interval of the turbo vane portions and expands from the inner circumference to the outer circumference.

Vane Thickness

Figure 12:
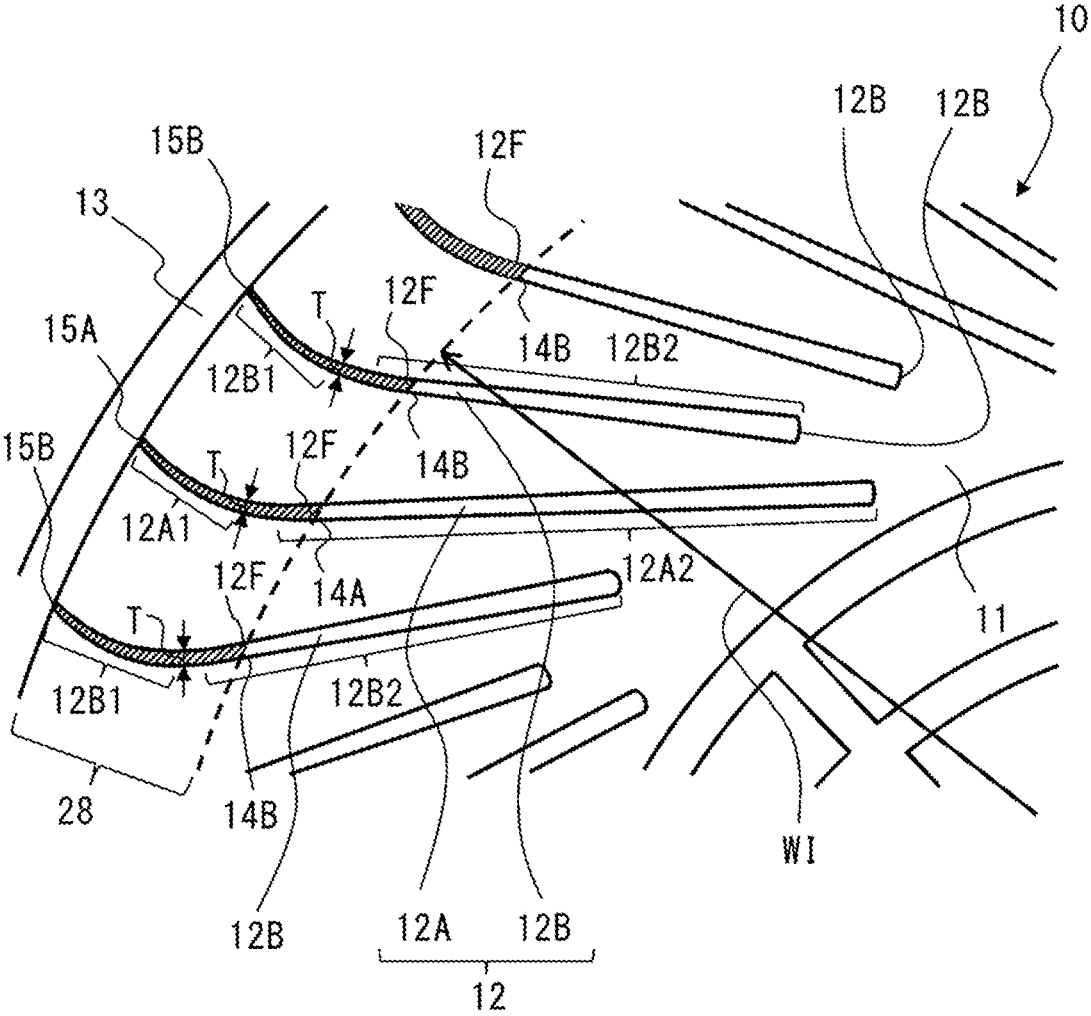
FIG. 12 is an enlarged view that illustrates a portion of the impeller that is in range E in the impeller illustrated in FIG. 6.

FIG. 12 is an enlarged view that illustrates a portion of the impeller 10 that is in range E in the impeller 10 illustrated in FIG. 6. A vane thickness T of each of the blades 12 is described below with reference to FIG. 12. FIG. 12 is an enlarged plan view that illustrates a portion of the impeller 10 in a case in which the impeller 10 is viewed in a direction of a point of sight V represented by an open arrow illustrated in FIG. 8.

As illustrated in FIG. 4, FIG. 5, and FIG. 12, at end portions 12F of the plurality of blades 12 that are close to the corresponding one of the side plates 13 in the axial direction of the rotation axis RS, portions of the plurality of blades 12 that are closer to the outer circumference than is a blade inner diameter WI of the respective inner circumferential ends of the plurality of blades 12 is defined as an blade outer circumferential portion 28. In FIG. 12, the end portions 12F of the plurality of blades 12 that are close to the corresponding one of the side plates 13 in the axial direction of the rotation axis RS are represented by portions of the blades 12 hatched with diagonal lines. In addition, the respective inner circumferential ends of the plurality of blades 12 are the inner circumferential ends 14A of the first blades 12A and the inner circumferential ends 14B of the second blades 12B.

The blade outer circumferential portion 28 is formed such that, in the radial directions centered on the rotation axis RS, the vane thickness T of each of the plurality of blades 12 is decreased from the inner circumference toward the outer circumference of the impeller 10. The blade outer circumferential portion 28 may also be formed such that, the vane thickness T at each of only the sirocco vane portions, which are the first sirocco vane portions 12A1 and the second sirocco vane portions 12B1, of the plurality of blades 12 is decreased from the inner circumference toward the outer circumference in a radial direction. The vane thickness T of each of the blades 12 is a thickness of the blade 12 in a case in which the blade 12 is viewed in the axial direction of the rotation axis RS and in a direction at right angles to a center line of the blade 12.

Relationship Between Impeller 10 and Scroll Casing 40

Figure 13:
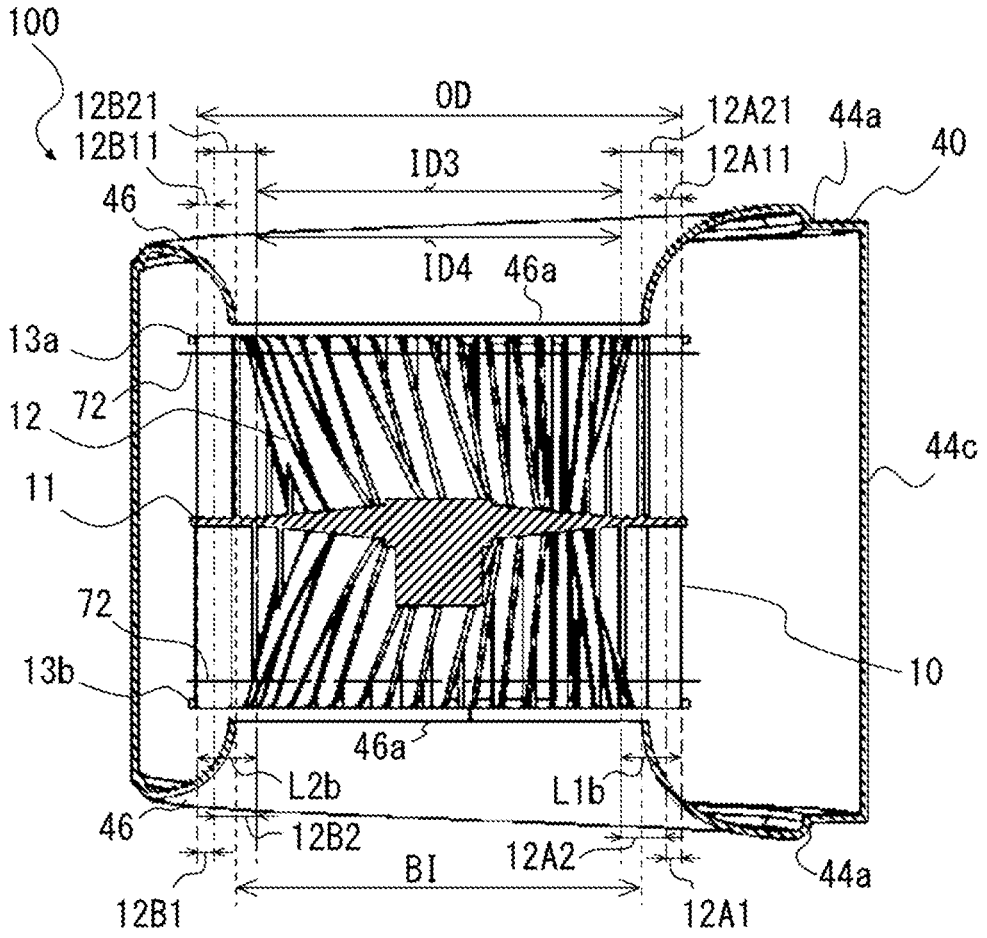
FIG. 13 is a schematic view that illustrates a relationship between the impeller and a scroll casing included in the centrifugal air-sending device illustrated in FIG. 2 with the centrifugal air-sending device viewed in the section taken along line A-A.
Figure 14:
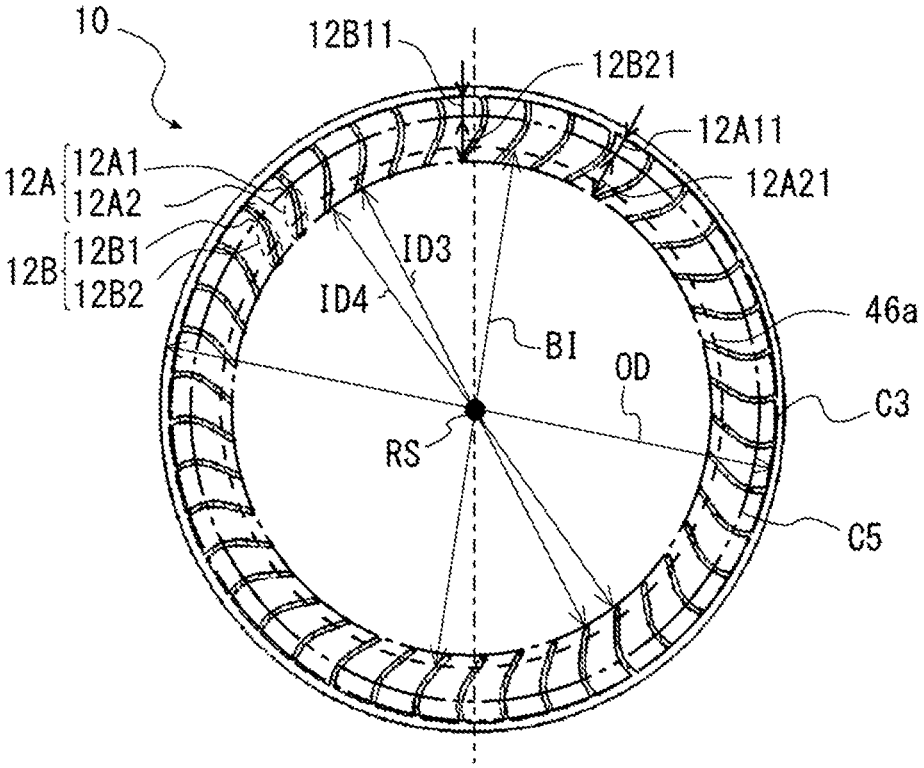
FIG. 14 is a schematic view that illustrates a relationship between the blades and a bell mouth with the impeller illustrated in FIG. 13 viewed parallel to the rotation axis.

FIG. 13 is a schematic view that illustrates a relationship between the impeller 10 and the scroll casing 40 included in the centrifugal air-sending device 100 illustrated in FIG. 2 with the centrifugal air-sending device 100 viewed in the section taken along line A-A. FIG. 14 is a schematic view that illustrates a relationship between the blades 12 and the bell mouth 46 with the impeller 10 illustrated in FIG. 13 viewed parallel to the rotation axis RS. As illustrated in FIG. 13 and FIG. 14, the blade outer diameter OD of the respective outer circumferential ends of the plurality of blades 12 is larger than an inner diameter BI of the bell mouth 46 included in the scroll casing 40. The blade outer diameter OD of the plurality of blades 12 is equal to the outer diameter OD1 and the outer diameter OD2 of the first blades 12A illustrated in FIG. 10 and the outer diameter OD3 and the outer diameter OD4 of the second blades 12B illustrated in FIG. 11 (blade outer diameter OD=outer diameter OD1=outer diameter OD2=outer diameter OD3=outer diameter OD4).

The impeller 10 has a portion in which the first turbo region 12A21 is larger than the first sirocco region 12A11 in the radial direction from the rotation axis RS. In other words, the impeller 10 and the plurality of first blades 12A have a portion in which a proportion for which the first turbo vane portion 12A2 accounts is higher in the radial direction from the rotation axis RS than a proportion for which the first sirocco vane portion 12A1 accounts and thus have a portion that has a relation of first sirocco vane portion 12A1<first turbo vane portion 12A2. Such a relationship on the proportion for which the first sirocco vane portion 12A1 accounts and the proportion for which the first turbo vane portion 12A2 accounts in a radial direction from the rotation axis RS may also be satisfied through all regions of the main-plate-side blade region 122*a*, which is the first region, and the side-plate-side blade region 122*b*, which is the second region.

The impeller 10 and the plurality of first blades 12A are not limited to the ones in which a proportion for which the first turbo vane portion 12A2 accounts is higher in a radial direction from the rotation axis RS than a proportion for which the first sirocco vane portion 12A1 accounts and thus have a relation of first sirocco vane portion 12A1<first turbo vane portion 12A2. The impeller 10 and the first blades 12A may also be formed such that a proportion for which the first turbo vane portion 12A2 accounts is lower in a radial direction from the rotation axis RS than or equal to a proportion for which the first sirocco vane portion 12A1 accounts.

Similarly, the impeller 10 has a portion in which the second turbo region 12B21 is larger than the second sirocco region 12B11 in the radial direction from the rotation axis RS. In other words, the impeller 10 and the second blades 12B have a portion in which a proportion for which the second turbo vane portion 12B2 accounts is higher in a radial direction from the rotation axis RS than a proportion for which the second sirocco vane portion 12B1 accounts and thus have a portion that has a relation of second sirocco vane portion 12B1<second turbo vane portion 12B2. Such a relationship on the proportion for which the second sirocco vane portion 12B1 and the proportion for which the second turbo vane portion 12B2 accounts in a radial direction from the rotation axis RS may also be satisfied through all regions of the main-plate-side blade region 122*a*, which is the first region, and the side-plate-side blade region 122*b*, which is the second region.

The impeller 10 and the second blades 12B are not limited to the ones in which a proportion for which the second turbo vane portion 12B2 accounts is higher in a radial direction from the rotation axis RS than a proportion for which the second sirocco vane portion 12B1 accounts and thus have a relation of second sirocco vane portion 12B1<second turbo vane portion 12B2. The impeller 10 and the second blades 12B may also be formed such that a proportion for which the second turbo vane portion 12B2 accounts is lower in a radial direction centered on the rotation axis RS than or equal to a proportion for which the second sirocco vane portion 12B1 accounts.

Figure 15:
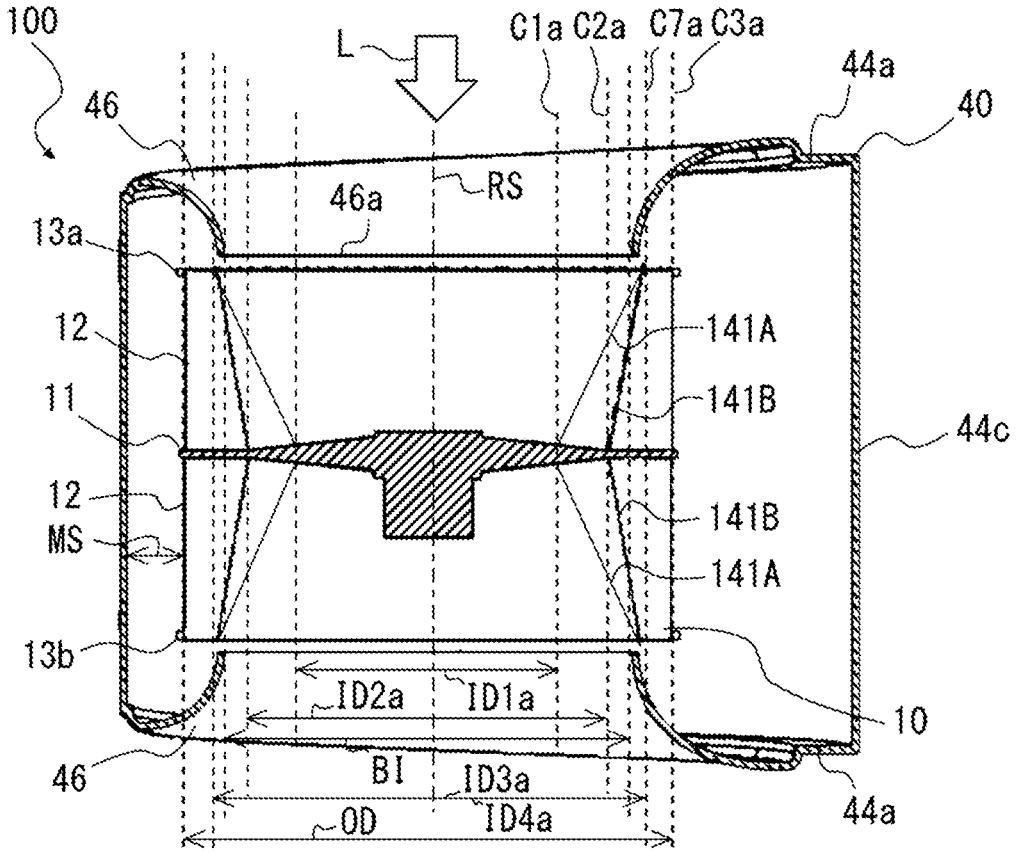
FIG. 15 is a schematic view that further illustrates in detail the relationship between the impeller and the scroll casing included in the centrifugal air-sending device illustrated in FIG. 2 with the centrifugal air-sending device viewed in the section taken along line A-A.
Figure 16:
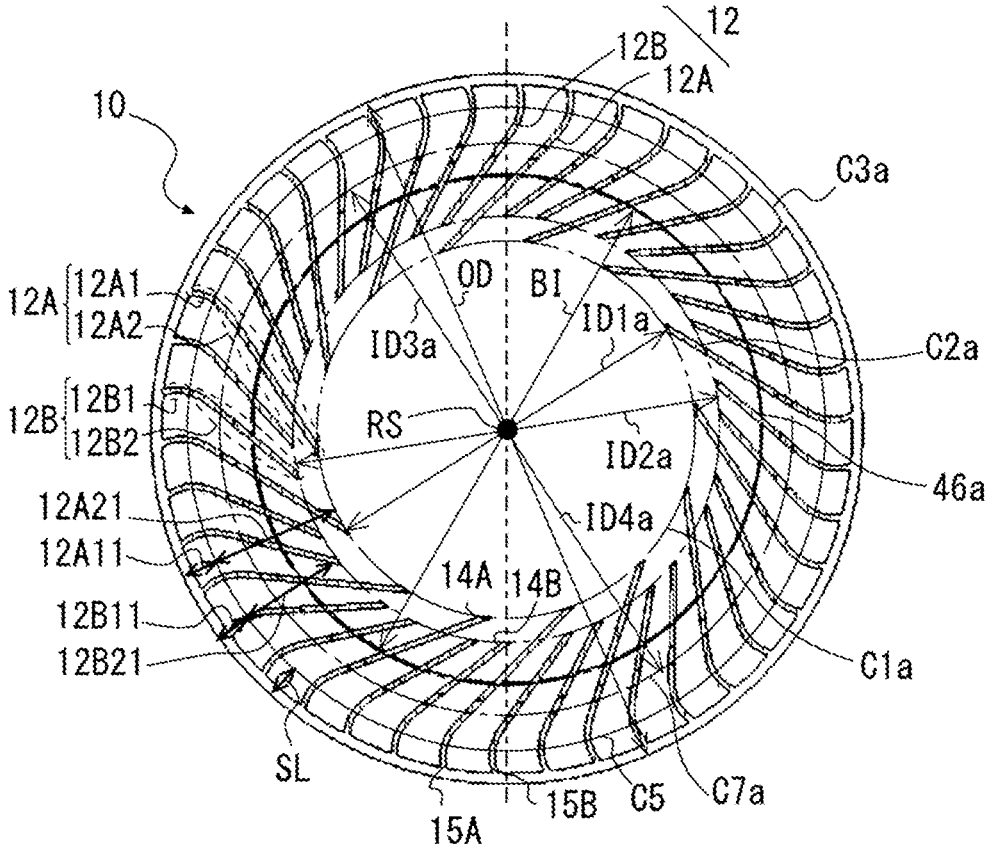
FIG. 16 is a schematic view that illustrates the relationship between the blades and the bell mouth with the impeller illustrated in FIG. 15 viewed parallel to the rotation axis.

FIG. 15 is a schematic view that further illustrates in detail the relationship between the impeller 10 and the scroll casing 40 included in the centrifugal air-sending device 100 illustrated in FIG. 2 with the centrifugal air-sending device 100 viewed in the section taken along line A-A. FIG. 16 is a schematic view that illustrates the relationship between the blades 12 and the bell mouth 46 with the impeller 10 illustrated in FIG. 15 viewed parallel to the rotation axis RS. An open arrow L illustrated in FIG. 15 represents a direction in which the impeller 10 is viewed parallel to the rotation axis RS.

As illustrated in FIG. 15 and FIG. 16, a circle is defined as a circle Cia that passes the inner circumferential ends 14A of the plurality of first blades 12A centered on the rotation axis RS at a connection position at which the first blades 12A and the main plate 11 are connected to each other when the circle is viewed parallel to the rotation axis RS. The diameter of the circle Cia, that is, an inner diameter of the first blades 12A at the connection position, at which the first blades 12A and the main plate 11 are connected to each other, is defined as an inner diameter IDia.

A circle is also defined as a circle C2*a* that passes the inner circumferential ends 14B of the plurality of second blades 12B centered on the rotation axis RS at a connection position at which the second blades 12B and the main plate 11 are connected to each other when the circle is viewed parallel to the rotation axis RS. The diameter of the circle C2*a*, that is, an inner diameter of the second blades 12B at the connection position, at which the first blades 12A and the main plate 11 are connected to each other, is defined as an inner diameter ID2*a*. The inner diameter ID2*a* is larger than the inner diameter ID1*a* (inner diameter ID2*a*>inner diameter ID1*a*).

When the circle C3*a* is viewed parallel to the rotation axis RS, the diameter of the circle C3*a*, which passes the outer circumferential ends 15A of the plurality of first blades 12A and the outer circumferential ends 15B of the second blades 12B around the rotation axis RS as its center, that is, the outer diameter of the plurality of blades 12 is also referred to as a blade outer diameter OD.

A circle is also defined as a circle C7*a* that passes the inner circumferential ends 14A of the plurality of first blades 12A centered on the rotation axis RS at a connection position at which the first blades 12A and the corresponding one of the side plates 13 are connected to each other when the circle is viewed parallel to the rotation axis RS. The diameter of the circle C7*a*, that is, an inner diameter of the first blades 12A at the connection position, at which the first blades 12A and the corresponding one of the side plates 13 are connected to each other, is defined as an inner diameter ID3*a*.

A circle is also defined as a circle C7*a* that passes the inner circumferential ends 14B of the plurality of second blades 12B centered on the rotation axis RS at a connection position at which the second blades 12B and the corresponding one of the side plates 13 are connected to each other when the circle is viewed parallel to the rotation axis RS. The diameter of the circle C7*a*, that is, an inner diameter of the second blades 12B at the connection position, at which the second blades 12B and the corresponding one of the side plates 13 are connected to each other, is defined as an inner diameter ID4*a*.

As illustrated in FIG. 15 and FIG. 16, when the bell mouth 46 is viewed parallel to the rotation axis RS, the position of the inner diameter BI of the bell mouth 46 is located between the inner diameter ID1*a* of the first blades 12A, which is at the main plate 11, and the inner diameter ID3*a* of the first blades 12A, which is at the corresponding one of the side plates 13, and in the regions of the first turbo vane portions 12A2 and the second turbo vane portions 12B2. More specifically, the inner diameter BI of the bell mouth 46 is larger than the inner diameter ID1*a* of the first blades 12A, which is at the main plate 11, and smaller than the inner diameter ID3*a* of the first blades 12A, which is at the corresponding one of the side plates 13.

In other words, the inner diameter BI of the bell mouth 46 is larger than the blade inner diameter of the plurality of blades 12 that is at the main plate 11 and smaller than the blade inner diameter of the plurality of blades 12 that is at the corresponding one of the side plates 13. In other words, when an inner circumferential edge portion 46*a* is viewed parallel to the rotation axis RS, the inner circumferential edge portion 46*a*, which forms the inner diameter BI of the bell mouth 46, is located between the circle CIa and the circle C7*a* and in the regions of the first turbo vane portions 12A2 and the second turbo vane portions 12B2.

As illustrated in FIG. 15 and FIG. 16, when the bell mouth 46 is viewed parallel to the rotation axis RS, the position of the inner diameter BI of the bell mouth 46 is located between the inner diameter ID2*a* of the second blades 12B, which is at the main plate 11, and the inner diameter ID4*a* of the second blades 12B, which is at the corresponding one of the side plates 13, and in the regions of the first turbo vane portions 12A2 and the second turbo vane portions 12B2. More specifically, the inner diameter BI of the bell mouth 46 is larger than the inner diameter ID2*a* of the second blades 12B, which is at the main plate 11, and smaller than the inner diameter ID4*a* of the second blades 12B, which is at the corresponding one of the side plates 13.

In other words, the inner diameter BI of the bell mouth 46 is larger than the blade inner diameter of the plurality of blades 12 that is at the main plate 11 and smaller than the blade inner diameter of the plurality of blades 12 that is at the corresponding one of the side plates 13. More specifically, the inner diameter BI of the bell mouth 46 is larger than the blade inner diameter of the respective inner circumferential ends of the plurality of blades 12 in the first region and smaller than the blade inner diameter of the respective inner circumferential ends of the plurality of blades 12 in the second region. In other words, when the inner circumferential edge portion 46*a* is viewed parallel to the rotation axis RS, the inner circumferential edge portion 46*a*, which forms the inner diameter BI of the bell mouth 46, is located between the circle C2*a* and the circle C7*a* and in the regions of the first turbo vane portions 12A2 and the second turbo vane portions 12B2.

As illustrated in FIG. 16, a radial length of each of the first sirocco vane portions 12A1 and the second sirocco vane portions 12B1 in a radial direction of the impeller 10 is defined as a distance SL. As illustrated in FIG. 15, the closest-approach distance between which the plurality of blades 12 in the impeller 10 are closest to the circumferential wall 44*c* of the scroll casing 40, in the centrifugal air-sending device 100 is also defined as a distance MS. In this case, the distance MS in the centrifugal air-sending device 100 is larger than twice the distance SL (distance MS>distance SL×2). The distance MS, which is marked in the section of the centrifugal air-sending device 100 taken along line A-A illustrated in FIG. 15, is the closest-approach distance between which the plurality of blades 12 are closest to the circumferential wall 44*c* of the scroll casing 40 and is not necessarily marked in the section taken along line A-A.

Figure 17:
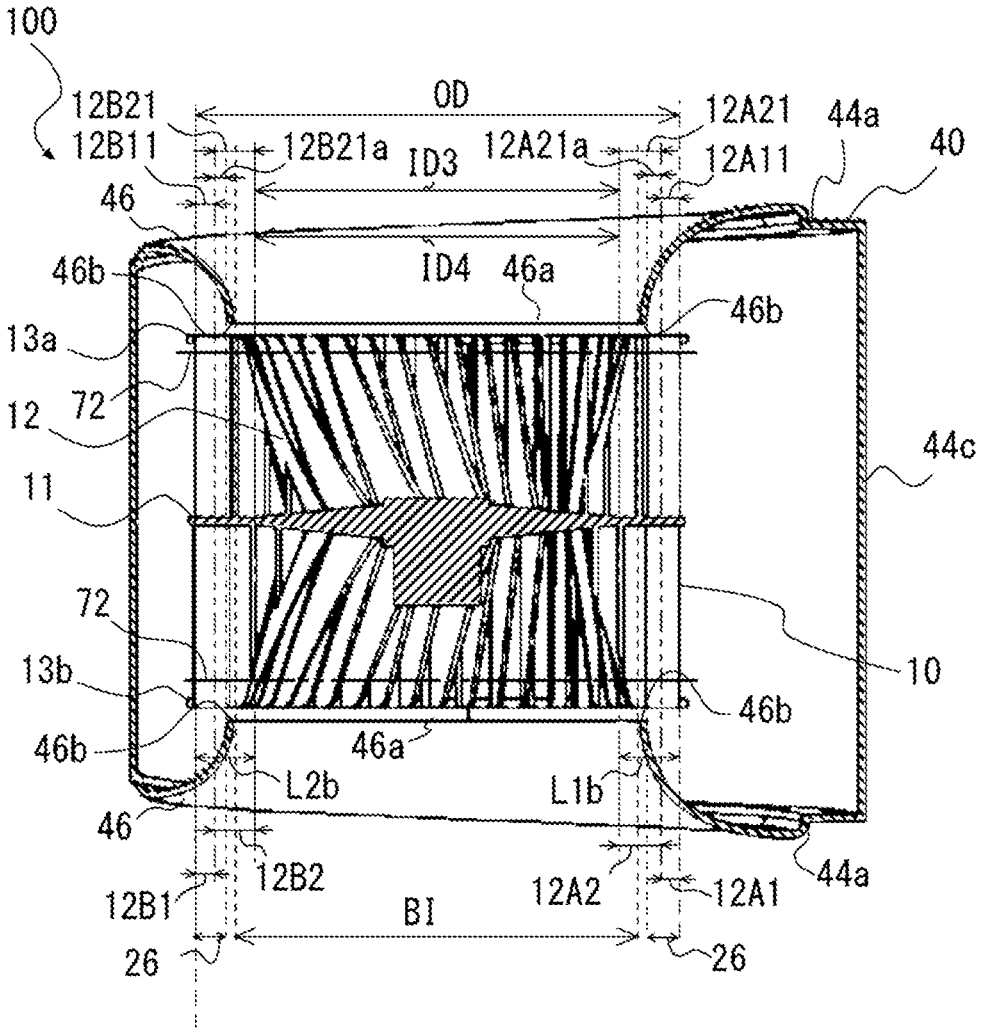
FIG. 17 is a schematic view that illustrates the relationship between the impeller and the scroll casing included in the centrifugal air-sending device illustrated in FIG. 2 with the centrifugal air-sending device viewed in the section taken along line A-A.
Figure 18:
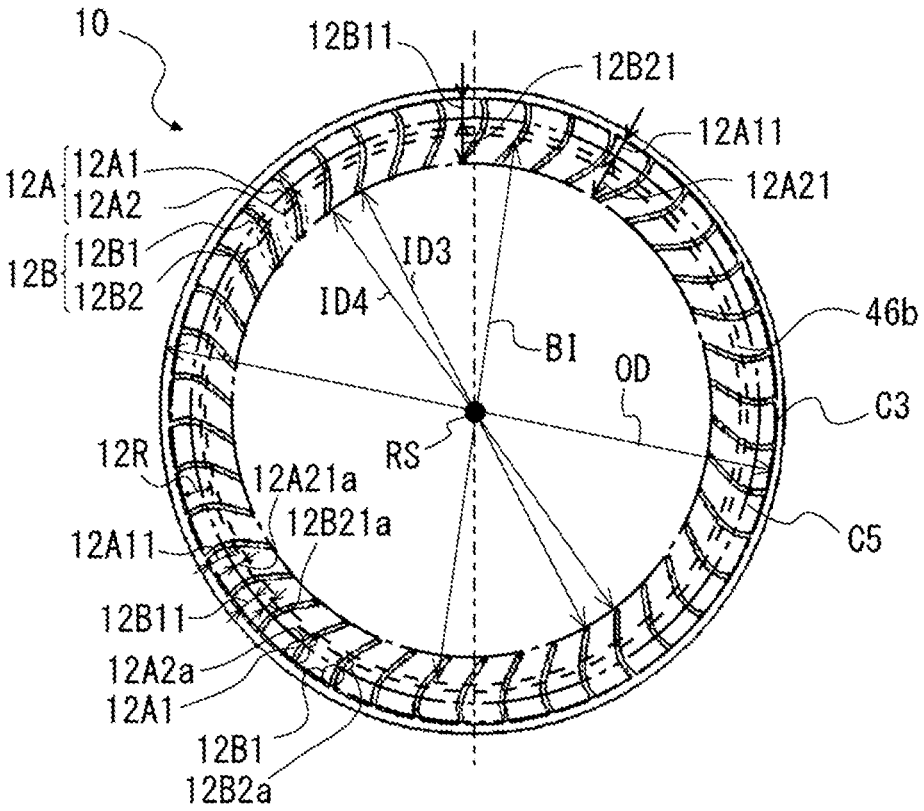
FIG. 18 is a schematic view that illustrates the relationship between the blades and the bell mouth with the impeller illustrated in FIG. 17 viewed in a second section and viewed parallel to the rotation axis.

FIG. 17 is a schematic view that illustrates a relationship between the impeller 10 and the bell mouth 46 included in the centrifugal air-sending device 100 illustrated in FIG. 2 with the centrifugal air-sending device 100 viewed in the section taken along line A-A. FIG. 18 is a schematic view that illustrates a relationship between the blades 12 and the bell mouth 46 with the impeller 10 illustrated in FIG. 17 viewed in a second section and viewed parallel to the rotation axis RS. The blades 12 located outside the inner diameter BI of the bell mouth 46 are across the first sirocco vane portions 12A1 and the first turbo vane portion 12A2. The blades 12 located outside the inner diameter BI of the bell mouth 46 are also across the second sirocco vane portions 12B1 and the second turbo vane portions 12B2.

In addition, when the bell mouth 46 is viewed parallel to the rotation axis RS, portions of the plurality of blades 12 located closer to the outer circumference than is an inner circumferential side end portion 46*b*, which is an inner circumferential end portion of the bell mouth 46 in the radial directions from the rotation axis RS, is defined as an outer circumferential region portion 26. The impeller 10 is formed such that the proportion for which the first sirocco vane portion 12A1 accounts is higher than the proportion for which the first turbo vane portion 12A2 accounts in the outer circumferential region portion 26. In other words, when the first sirocco region 12A11 is viewed parallel to the rotation axis RS, in the outer circumferential region portion 26 of the impeller 10, which is located closer to the outer circumference than is the inner circumferential side end portion 46*b* of the bell mouth 46, the first sirocco region 12A11 is larger than the first turbo region 12A21*a* in the radial directions from the rotation axis RS. The inner circumferential side end portion 46*b* is ring-shaped centered on the rotation axis RS and forms the inner circumferential edge portion 46*a*.

When the first turbo region 12A21*a* is viewed parallel to the rotation axis RS, the first turbo region 12A21*a* is a region in the first turbo region 12A21 and closer to the outer circumference than is the inner circumferential side end portion 46*b* of the bell mouth 46. When the first turbo vane portions 12A2 that define the first turbo region 12A21*a* are defined as first turbo vane portions 12A2*a*, the outer circumferential region portion 26 of the impeller 10 preferably has the proportion for which the first sirocco vane portion 12A1 accounts higher than the proportion for which the first turbo vane portion 12A2*a* accounts. Such a relationship on the proportion for which the first sirocco vane portion 12A1 and the proportion for which the first turbo vane portion 12A2*a* accounts in the outer circumferential region portion 26 may also be satisfied through all regions of the main-plate-side blade region 122*a*, which is the first region, and the side-plate-side blade region 122*b*, which is the second region.

The impeller 10 is further preferably formed such that the proportion for which the second sirocco vane portion 12B1 accounts is higher than the proportion for which the second turbo vane portion 12B2 accounts in the outer circumferential region portion 26. In other words, when the impeller 10 is viewed parallel to the rotation axis RS, in the outer circumferential region portion 26 of the impeller 10, which is located closer to the outer circumference than is the inner circumferential side end portion 46*b* of the bell mouth 46, the second sirocco region 12B11 is larger than the second turbo region 12B21*a* in the radial direction from the rotation axis RS.

When the second turbo region 12B21*a* is viewed parallel to the rotation axis RS, the second turbo region 12B21*a* is a region in the second turbo region 12B21 and closer to the outer circumference than is the inner circumferential side end portion 46*b* of the bell mouth 46. When the second turbo vane portions 12B2 that define the second turbo region 12B21*a* are defined as second turbo vane portions 12B2*a*, the outer circumferential region portion 26 of the impeller 10 preferably has the proportion for which the second sirocco vane portions 12B1 account higher than the proportion for which the second turbo vane portions 12B2*a* account. Such a relationship on the proportion for which the second sirocco vane portion 12B1 and the proportion for which the second turbo vane portion 12B2*a* accounts in the outer circumferential region portion 26 may also be satisfied through all regions of the main-plate-side blade region 122*a*, which is the first region, and the side-plate-side blade region 122*b*, which is the second region.

Operation of Centrifugal Air-Sending Device 100

Operation of the centrifugal air-sending device is described below with reference to FIG. 1. When an unillustrated motor drives, the main plate 11, to which a motor shaft is connected, rotates and, through the main plate 11, the plurality of blades 12 in the centrifugal air-sending device 100 rotate about the rotation axis RS. Air outside the scroll casing 40 of the centrifugal air-sending device 100 is thus sucked from the suction ports 45 into the impeller 10 and blown out from the impeller 10 into the scroll casing 40 through pressure-rising action performed by the impeller 10. The air blown out from the impeller 10 into the scroll casing 40 is decelerated at an expansion air passage partly defined by the circumferential wall 44*c* of the scroll casing 40, recovers static pressure, and is blown out from the discharge port 42*a* illustrated in FIG. 1 to the outside.

Action and Advantageous Effects of Centrifugal Air-Sending Device 100

Figure 19:
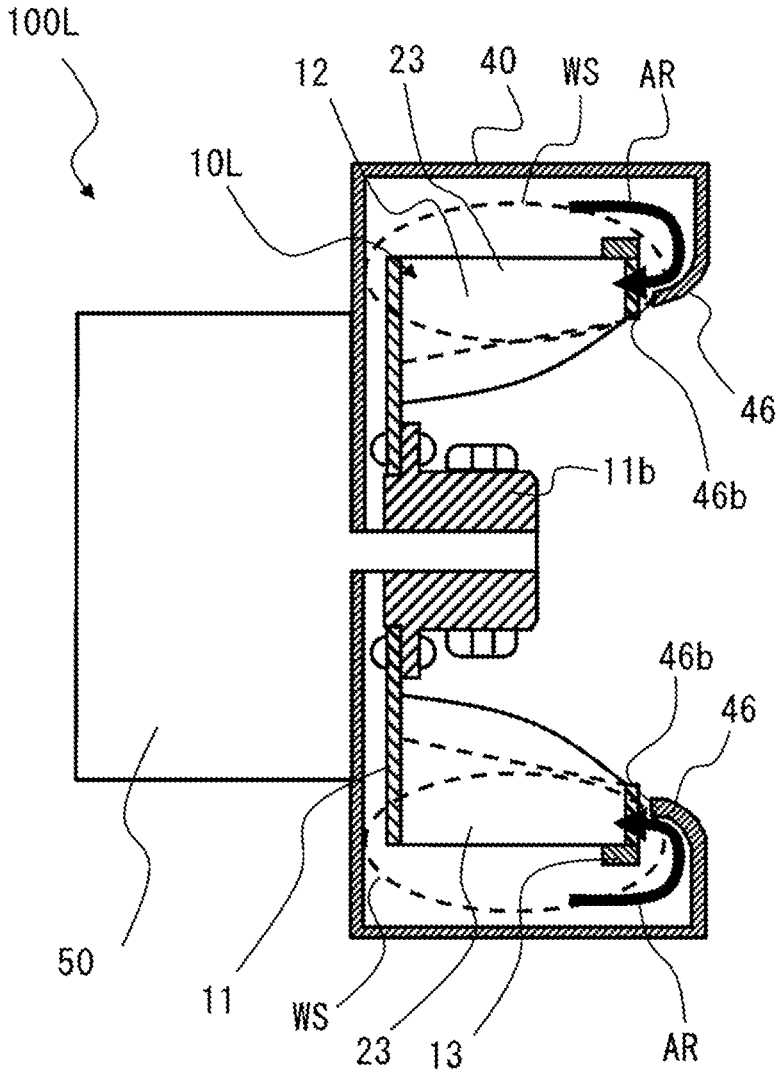
FIG. 19 is a sectional view that illustrates a centrifugal air-sending device according to a comparative example.

FIG. 19 is a sectional view that illustrates a centrifugal air-sending device 100L according to a comparative example. In the centrifugal air-sending device 100L, an impeller 10L is connected to a driving source 50, such as a motor. In the centrifugal air-sending device 100L according to the comparative example, portions of the blades 12 that are indicated by regions WS and located further outside than is the inner circumferential side end portion 46*b* of the bell mouth 46 are only portions formed as sirocco vane portions 23. An airflow AR that is blown out from the impeller 10L and passes along the inner wall surface of the bell mouth 46 thus collides with portions of the sirocco vane portions 23, which each have a large outlet angle and at which the airflow passes at increased inflow velocity when the airflow flows into the impeller 10L again. The airflow AR that collides with the sirocco vane portions 23 causes noise generated from the centrifugal air-sending device 100L and deterioration in input. Such deterioration in input is a state in which, for example, an airflow collides with the blades 12 and thus resists the rotation of the impeller 10L and then electric power required for the centrifugal air-sending device 100L is increased.

On the other hand, the blade outer circumferential portion 28 in the centrifugal air-sending device 100 according to Embodiment 1 is formed such that the vane thickness T of each of the plurality of blades 12 is decreased from the inner circumference toward the outer circumference in a radial direction. In the centrifugal air-sending device 100, the vane intervals in the impeller 10 are thus gradually increased and an opening area of each of the vane intervals is also increased toward discharge ports of the blades 12.

The centrifugal air-sending device 100, which has the configuration described above, is configured to further reduce rapid pressure fluctuation when air is blown out from the impeller 10 and increase the amount of air blown out from the impeller 10 in comparison with the centrifugal air-sending device 100L, which does not have the configuration described above. As a result, in the centrifugal air-sending device 100, which has the configuration described above, much air blown out from the impeller 10 passes along an inner wall surface of the bell mouth 46 into a portion of the impeller 10 that is at the inner circumference and collides with the turbo vane portions, which each have a small outlet angle and at which an airflow passes at decreased inflow velocity.

In the centrifugal air-sending device 100 according to Embodiment 1, when the airflow that flows along the inner wall surface of the bell mouth 46 passes into the impeller 10 again, the airflow collides with the turbo vane portions, which each have a small outlet angle and at which the airflow passes at decreased inflow velocity, noise generated from the airflow is thus prevented and deterioration in input is prevented as well.

Embodiment 2

Figure 20:
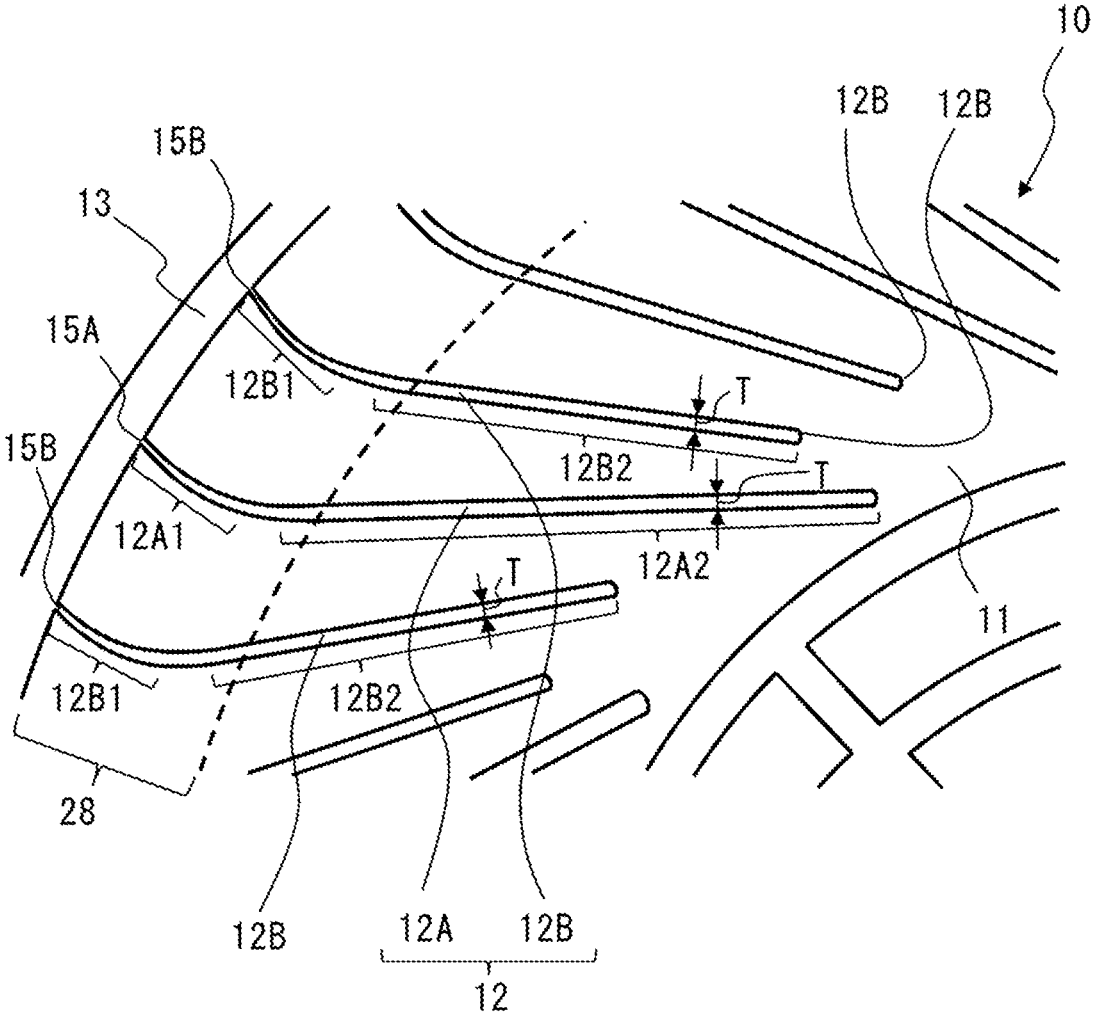
FIG. 20 is a sectional view that illustrates a portion of an impeller included in a centrifugal air-sending device according to Embodiment 2 that is in range E in the impeller illustrated in FIG. 6.

FIG. 20 is a sectional view that illustrates a portion of the impeller 10 included in a centrifugal air-sending device 100 according to Embodiment 2 that is in range E in the impeller 10 illustrated in FIG. 6. Components that are the same in configuration as those of the centrifugal air-sending device 100 or other devices illustrated in FIG. 1 to FIG. 19 are given the same reference signs and description of such components is omitted. The centrifugal air-sending device 100 according to Embodiment 2 is to be further specified in vane thickness T of each of the blades 12 included in the centrifugal air-sending device 100 according to Embodiment 1.

The plurality of blades 12 in the centrifugal air-sending device 100 according to Embodiment 2 are formed such that the vane thickness T at each of the first turbo vane portions 12A2 and the second turbo vane portions 12B2 of the blades 12 is constant in each section in the axial direction of the rotation axis RS from the inner circumference toward the outer circumference of the impeller 10.

Action and Advantageous Effects of Centrifugal Air-Sending Device 100

The centrifugal air-sending device 100 according to Embodiment 2 is formed such that the vane thickness T at each of the turbo vane portions of the blades 12 is constant in each section in the axial direction of the rotation axis RS from the inner circumference toward the outer circumference of the impeller 10. The centrifugal air-sending device 100, which has the configuration described above, is thus configured to further reduce rapid pressure fluctuation when air is blown out from the impeller and increase the amount of air blown out from the impeller 10 in comparison with the centrifugal air-sending device 100L, which does not have the configuration described above. As a result, in the centrifugal air-sending device 100, which has the configuration described above, much air blown out from the impeller 10 passes along the inner wall surface of the bell mouth 46 into a portion of the impeller 10 that is at the inner circumference and collides with the turbo vane portions, which each have a small outlet angle and at which an airflow passes at decreased inflow velocity.

In the centrifugal air-sending device 100 according to Embodiment 2, when an airflow that flows along the inner wall surface of the bell mouth 46 passes into the impeller 10 again, the airflow collides with the turbo vane portions, which each have a small outlet angle and at which the airflow passes at decreased inflow velocity, noise generated from the airflow is thus prevented and deterioration in input is prevented as well. The centrifugal air-sending device 100 according to Embodiment 2, which has the configuration of the centrifugal air-sending device 100 according to Embodiment 1, is also configured to produce the same advantageous effects as the centrifugal air-sending device 100 according to Embodiment 1. In addition, the vane thickness T at each of the turbo vane portions of the blades 12 is designed to be constant in each section in the axial direction of the rotation axis RS from the inner circumference toward the outer circumference of the impeller 10, the impeller 10 is thus easily manufactured and the manufacture of impeller 10 requires less mold cost.

Embodiment 3

Figure 21:
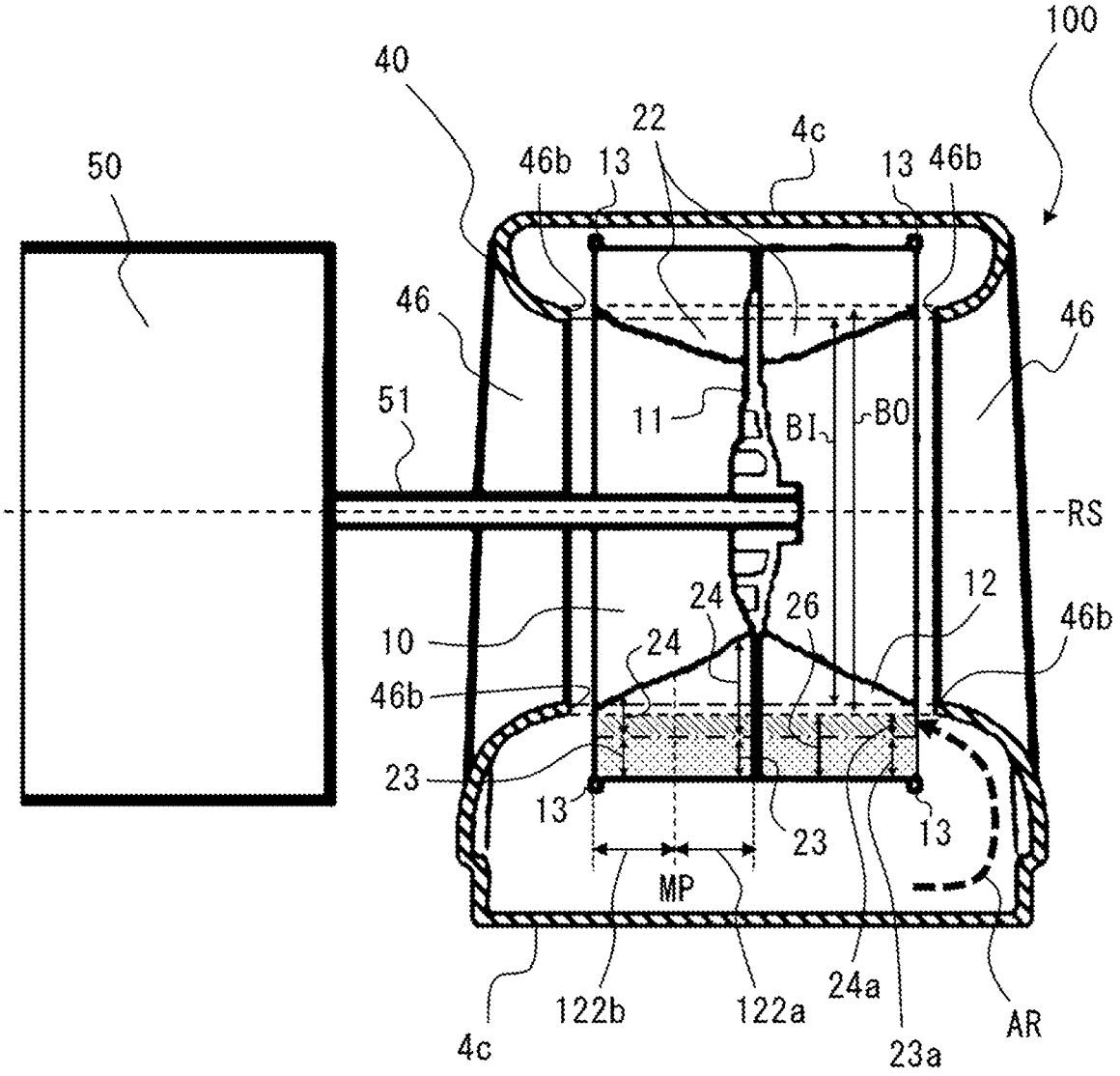
FIG. 21 is a conceptual view that illustrates a relationship between an impeller and a bell mouth included in a centrifugal air-sending device according to Embodiment 3.

FIG. 21 is a conceptual view that illustrates a relationship between the impeller 10 and the bell mouth 46 included in a centrifugal air-sending device 100 according to Embodiment 3. Components that are the same in configuration as those of the centrifugal air-sending device 100 or other devices illustrated in FIG. 1 to FIG. 20 are given the same reference signs and description of such components is omitted. The centrifugal air-sending device 100 according to Embodiment 3 is to be further specified in relationship between the impeller 10 and the scroll casing 40 included in the centrifugal air-sending device 100 according to Embodiment 1 and Embodiment 2. In the centrifugal air-sending device 100, the impeller 10 is connected to the driving source 50, such as a motor, through an output shaft 51.

As illustrated in FIG. 21, the blades 12 have blade inner portions 22, which extend further inward than the inner circumferential side end portion 46*b* of the bell mouth 46 in the radial directions from the rotation axis RS. The blade inner portions 22 are located at regions in which the inner diameter BI of the bell mouth 46 is located.

The plurality of blades 12 each have the vane length in the first region, which is formed greater than the vane length in the second region. The plurality of blades 12 also each have, in the vane length of the blades 12 in the radial direction, a portion in which the proportion for which the turbo vane portion 24 accounts is higher in a radial direction than the proportion for which the sirocco vane portion 23 accounts in any of the first region and the second region. As described above, the first region is the main-plate-side blade region 122*a* and the second region is the side-plate-side blade region 122*b*.

The outer circumferential region portion 26 is formed such that the proportion for which the sirocco vane portion 23 accounts is higher in the radial direction than the proportion for which the turbo vane portion 24 accounts in any of the first region and the second region. In other words, as illustrated in FIG. 21, in the radial length of the blades 12, the proportion for which an outer sirocco vane portion 23*a*, which is located further outside than is the outer diameter of the inner circumferential side end portion 46*b* of the bell mouth 46, accounts is specified to be higher than the proportion for which an outer turbo vane portion 24*a* accounts.

The first sirocco vane portions 12A1 and the second sirocco vane portions 12B1 are collectively referred to as the sirocco vane portions 23 illustrated in FIG. 21. The first turbo vane portions 12A2 and the second turbo vane portions 12B2 are collectively referred to as the turbo vane portions 24 illustrated in FIG. 21. The first sirocco vane portions 12A1 and the second sirocco vane portions 12B1, which are further outside than is the inner circumferential side end portion 46*b* of the bell mouth 46 when the sirocco vane portions are viewed parallel to the rotation axis RS, are collectively referred to as the outer sirocco vane portions 23*a* illustrated in FIG. 21. The outer turbo vane portions 24*a* are also portions of the first turbo vane portions 12A2 and the second turbo vane portions 12B2 that are closer to the outer circumference than is the inner circumferential side end portion 46*b* of the bell mouth 46 when the turbo vane portions are viewed parallel to the rotation axis RS. The first turbo vane portions 12A2*a* and the second turbo vane portions 12B2*a* are also collectively referred to as the outer turbo vane portions 24*a*.

Action and Advantageous Effects of Centrifugal Air-Sending Device 100

The outer circumferential region portion 26 in the centrifugal air-sending device 100 according to Embodiment 3 is formed such that the proportion for which the sirocco vane portion 23 accounts is higher in the radial direction than the proportion for which the turbo vane portion 24 accounts in the first region and the second region. The centrifugal air-sending device 100, which has the configuration described above, is configured to further increase a pressure of an airflow blown out from the impeller 10 and an air volume in comparison with the centrifugal air-sending device 100L, which does not have the configuration described above. In the centrifugal air-sending device 100, which has the configuration described above, an airflow AR that passes along an inner wall surface of the bell mouth 46 passes into the impeller 10 again thus collides with the turbo vane portions 24, which each have a small outlet angle and at which the airflow passes at decreased inflow velocity. As a result, in the centrifugal air-sending device 100, when the airflow that passes along the inner wall surface of the bell mouth 46 passes into the impeller 10 again, noise generated from the airflow is thus prevented and deterioration in input is prevented as well.

The centrifugal air-sending device according to Embodiment 3, in which the proportion for which the sirocco vane portion 23 accounts is higher than the proportion for which the turbo vane portion 24 accounts at portions of the plurality of blades 12 that are further outside than is the inner circumferential side end portion 46*b* of the bell mouth 46, is also configured to increase pressure and an air volume.

Embodiment 4

Figure 22:
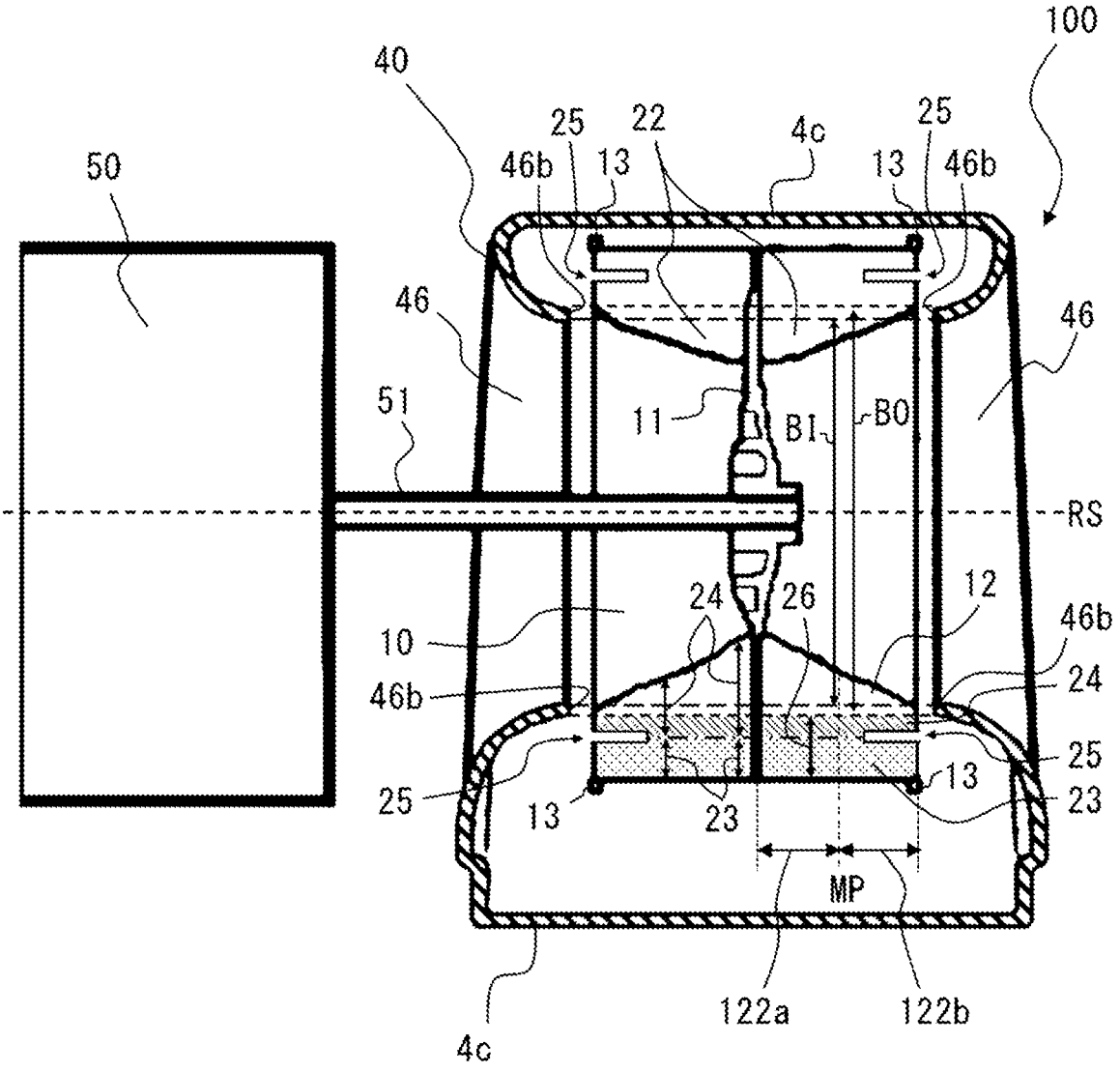
FIG. 22 is a sectional view that schematically illustrates a centrifugal air-sending device according to Embodiment 4.
Figure 23:
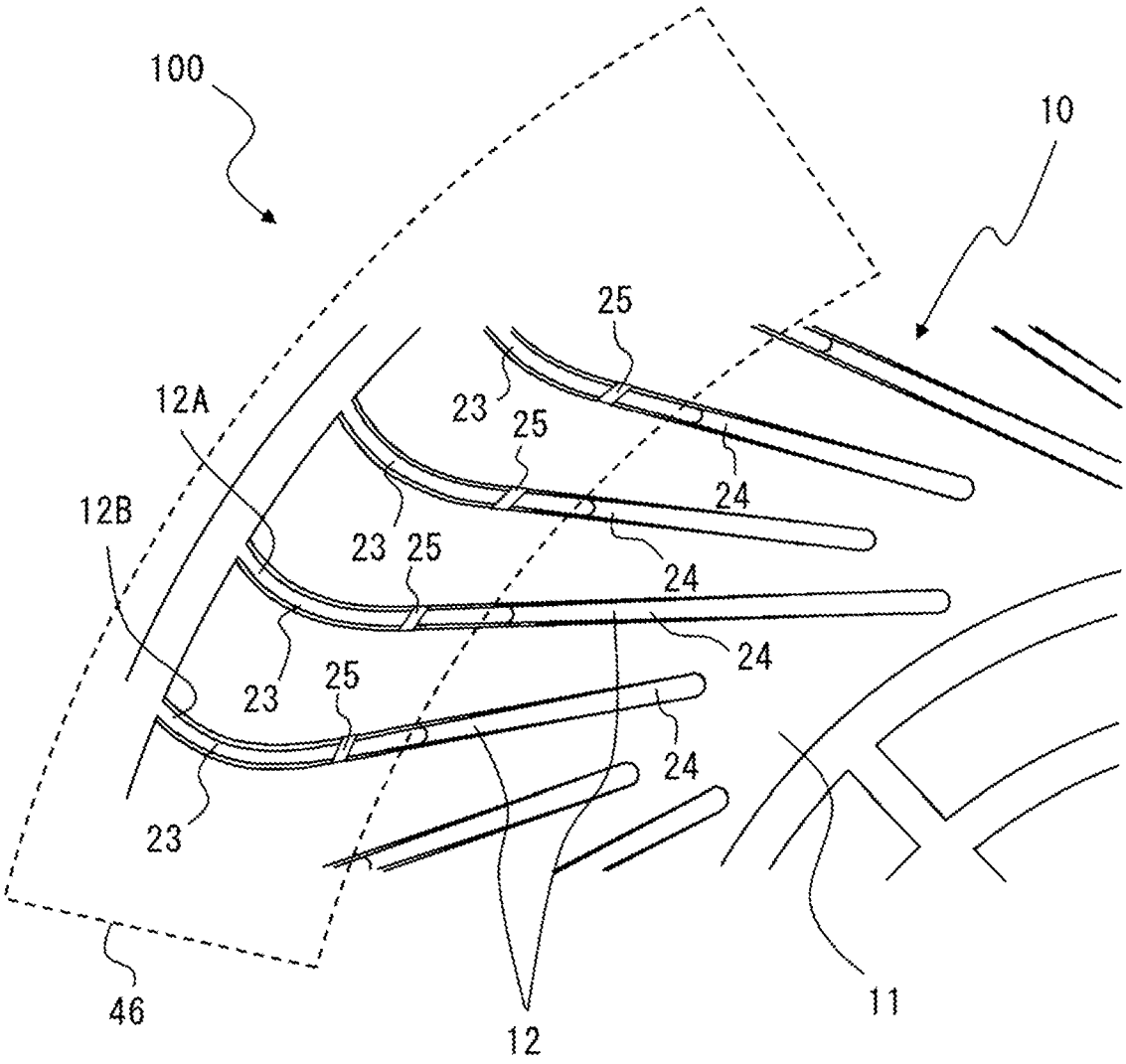
FIG. 23 is an enlarged view that illustrates a portion of the impeller included in the centrifugal air-sending device according to Embodiment 4 that is in range E in the impeller illustrated in FIG. 6.

FIG. 22 is a sectional view that schematically illustrates a centrifugal air-sending device 100 according to Embodiment 4. FIG. 23 is an enlarged view that illustrates a portion of the impeller 10 included in the centrifugal air-sending device 100 according to Embodiment 4 that is in range E in the impeller 10 illustrated in FIG. 6. Components that are the same in configuration as those of the centrifugal air-sending device 100 or other devices illustrated in FIG. 1 to FIG. 21 are given the same reference signs and description of such components is omitted. The centrifugal air-sending device 100 according to Embodiment 4 is to be further specified in configuration of the impeller 10 included in the centrifugal air-sending device 100 according to Embodiment 1 to Embodiment 3.

As illustrated in FIG. 22 and FIG. 23, the blades 12 have the turbo vane portions 24 and the sirocco vane portions 23 separated from each other in the side-plate-side blade region 122*b*, which is the second region. The blades 12 have separation portions 25 between the turbo vane portions 24 and the sirocco vane portions 23 in the radial directions centered on the rotation axis RS.

The separation portions 25 are each a through-hole that passes through the blades 12 in the radial directions centered on the rotation axis RS. The separation portions 25 are portions that are recessed from ends of the blades 12 located closest to the corresponding one of the side plates 13 toward the main plate 11 in the axial direction of the rotation axis RS. The separation portions 25 are opened only in the side-plate-side blade region 122*b*, which is the second region.

Action and Advantageous Effects of Centrifugal Air-Sending Device 100

The centrifugal air-sending device 100 according to Embodiment 4, in which the turbo vane portions 24 and the sirocco vane portions 23 are separated from each other, is configured to reduce loss caused by an airflow that passes into the sirocco vane portions 23. After an airflow leaks from the turbo vane portions 24, which are separated from the sirocco vane portions 23, and passes behind the turbo vane portions 24, the airflow is recovered at the sirocco vane portions 23, which are located behind the turbo vane portions 24, and loss is thus reduced. The centrifugal air-sending device 100 according to Embodiment 4, which has the same configuration as the centrifugal air-sending device 100 according to Embodiment 1 to Embodiment 3, is also configured to produce the same advantageous effects as the centrifugal air-sending device 100 according to Embodiment 1 to Embodiment 3.

Embodiment 5

Figure 24:
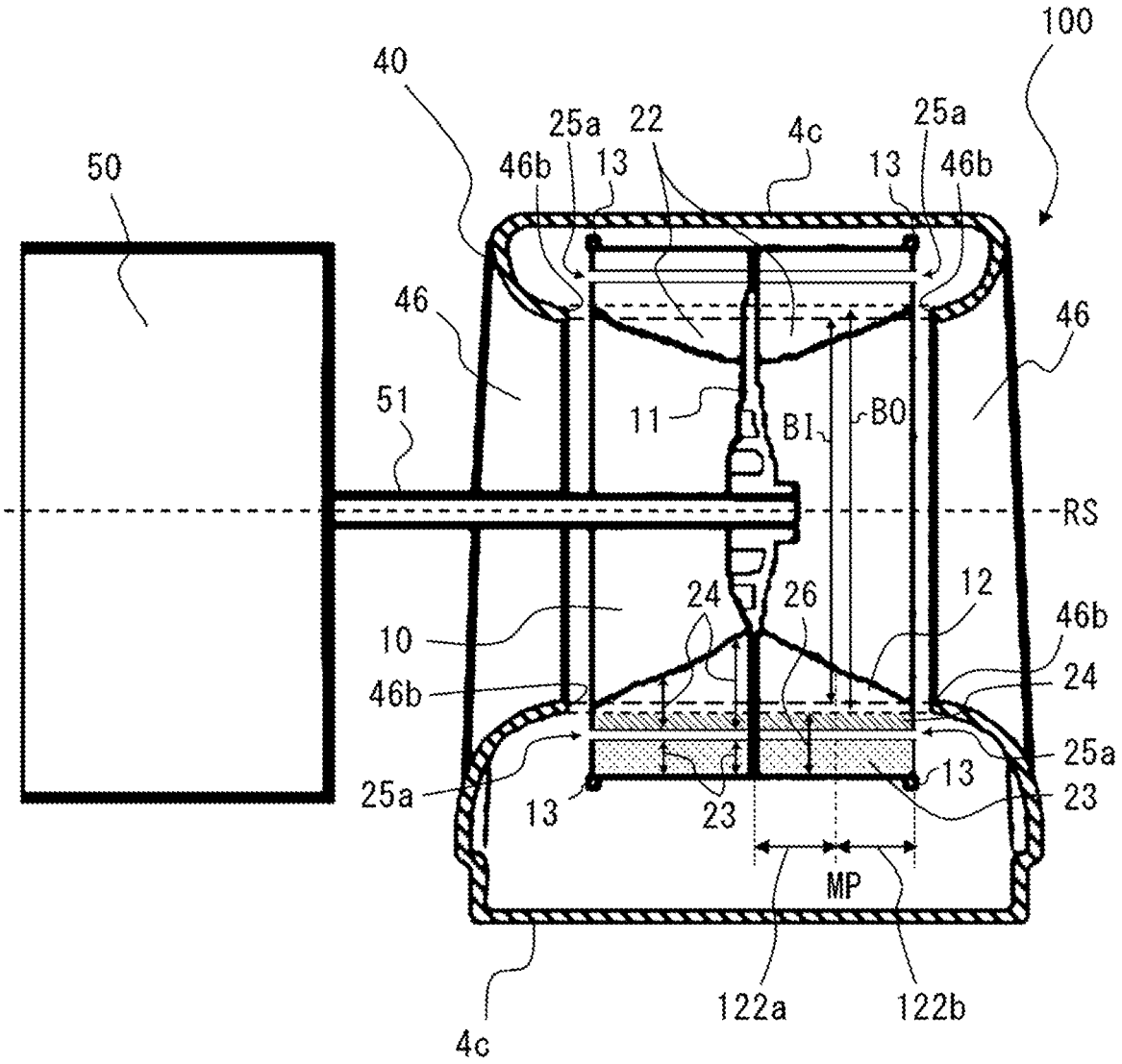
FIG. 24 is a sectional view that schematically illustrates a centrifugal air-sending device according to Embodiment 5.
Figure 25:
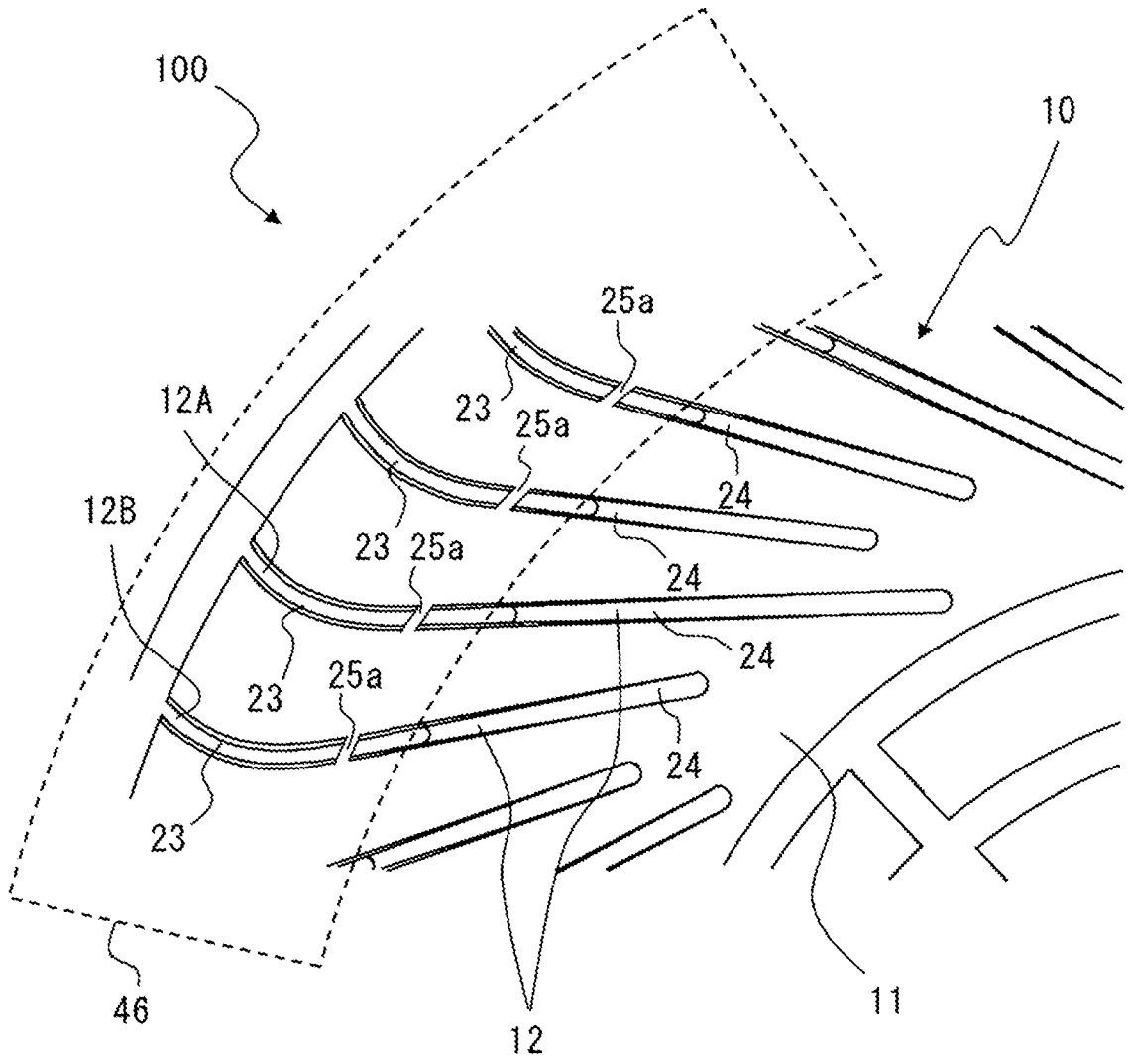
FIG. 25 is an enlarged view that illustrates a portion of the impeller included in the centrifugal air-sending device according to Embodiment 5 that is in range E in the impeller illustrated in FIG. 6.

FIG. 24 is a sectional view that schematically illustrates a centrifugal air-sending device 100 according to Embodiment 5. FIG. 25 is an enlarged view that illustrates a portion of the impeller 10 included in the centrifugal air-sending device 100 according to Embodiment 5 that is in range E in the impeller 10 illustrated in FIG. 6. Components that are the same in configuration as those of the centrifugal air-sending device 100 or other devices illustrated in FIG. 1 to FIG. 23 are given the same reference signs and description of such components is omitted. The centrifugal air-sending device 100 according to Embodiment 5 is to be further specified in configuration of the impeller 10 included in the centrifugal air-sending device 100 according to Embodiment 4.

As illustrated in FIG. 24 and FIG. 25, the blades 12 have the turbo vane portions 24 and the sirocco vane portions 23 separated from each other in the main-plate-side blade region 122*a*, which is the first region, and the side-plate-side blade region 122*b*, which is the second region. The blades 12 have separation portions 25*a* between the turbo vane portions 24 and the sirocco vane portions 23 in the radial directions centered on the rotation axis RS.

The separation portions 25*a* are each a through-hole that passes through the blades 12 in the radial directions centered on the rotation axis RS. The separation portions 25*a* are portions that are recessed from ends of the blades 12 located closest to the corresponding one of the side plates 13 toward the main plate 11 in the axial direction of the rotation axis RS. The separation portions 25*a* are opened in the main-plate-side blade region 122*a*, which is the first region, and the side-plate-side blade region 122*b*, which is the second region. The bottom portions of the separation portions 25*a* in the axial direction of the rotation axis RS may also be located at the main plate 11.

Action and Advantageous Effects of Centrifugal Air-Sending Device 100

The centrifugal air-sending device 100 according to Embodiment 5, in which the turbo vane portions 24 and the sirocco vane portions 23 are separated from each other, is configured to reduce loss caused by an airflow that passes into the sirocco vane portions 23. After an airflow leaks from the turbo vane portions 24, which are separated from the sirocco vane portions 23, and passes behind the turbo vane portions 24, the airflow is recovered at the sirocco vane portions 23, which are located behind the turbo vane portions 24, and loss is thus reduced. The centrifugal air-sending device 100 according to Embodiment 5, which has the same configuration as the centrifugal air-sending device 100 according to Embodiment 1 to Embodiment 4, is also configured to produce the same advantageous effects as the centrifugal air-sending device 100 according to Embodiment 1 to Embodiment 4.

The centrifugal air-sending device 100 according to Embodiment 1 to Embodiment 5 is described as an example, which has the impeller 10, which is a double-suction impeller that has the plurality of blades 12 formed on both faces of the main plate 11. Embodiment 1 to Embodiment 5 may also be applied to the centrifugal air-sending device 100 that has an impeller 10 that is a single-suction impeller that has the plurality of blades 12 formed on one face of the main plate 11.

Embodiment 6

Air-conditioning Apparatus 140

Figure 26:
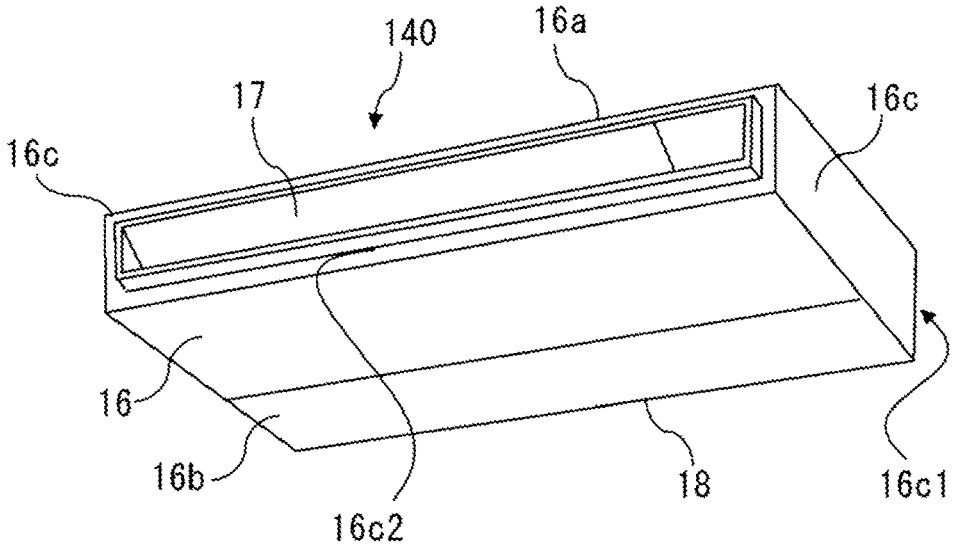
FIG. 26 is a perspective view that illustrates an example of an air-conditioning apparatus according to Embodiment 6.
Figure 27:
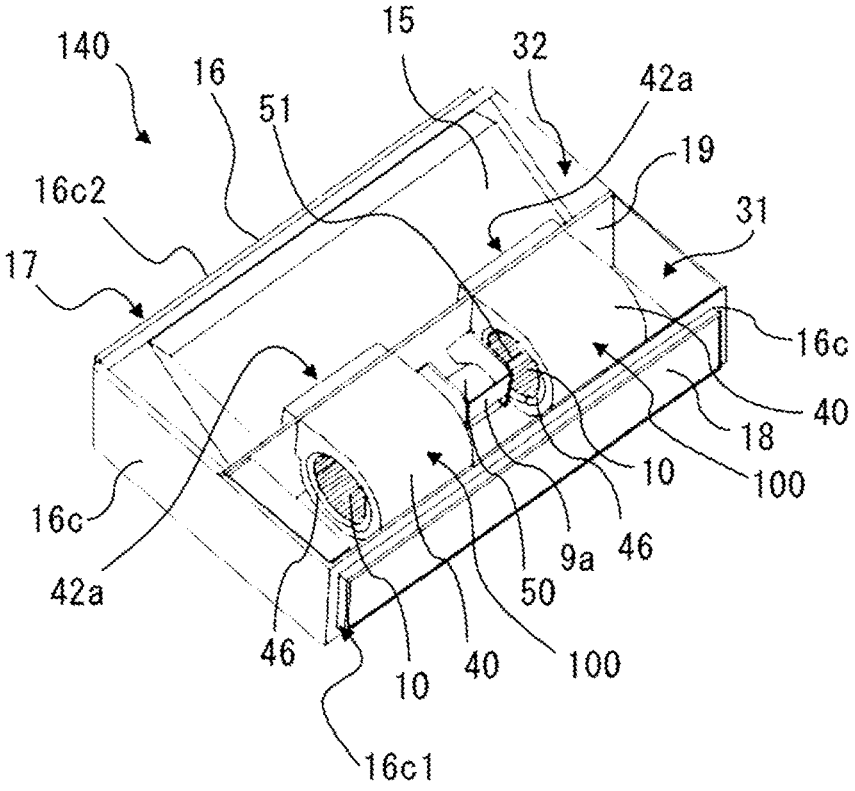
FIG. 27 is a perspective view that illustrates an example of an internal configuration of the air-conditioning apparatus according to Embodiment 6.
Figure 28:
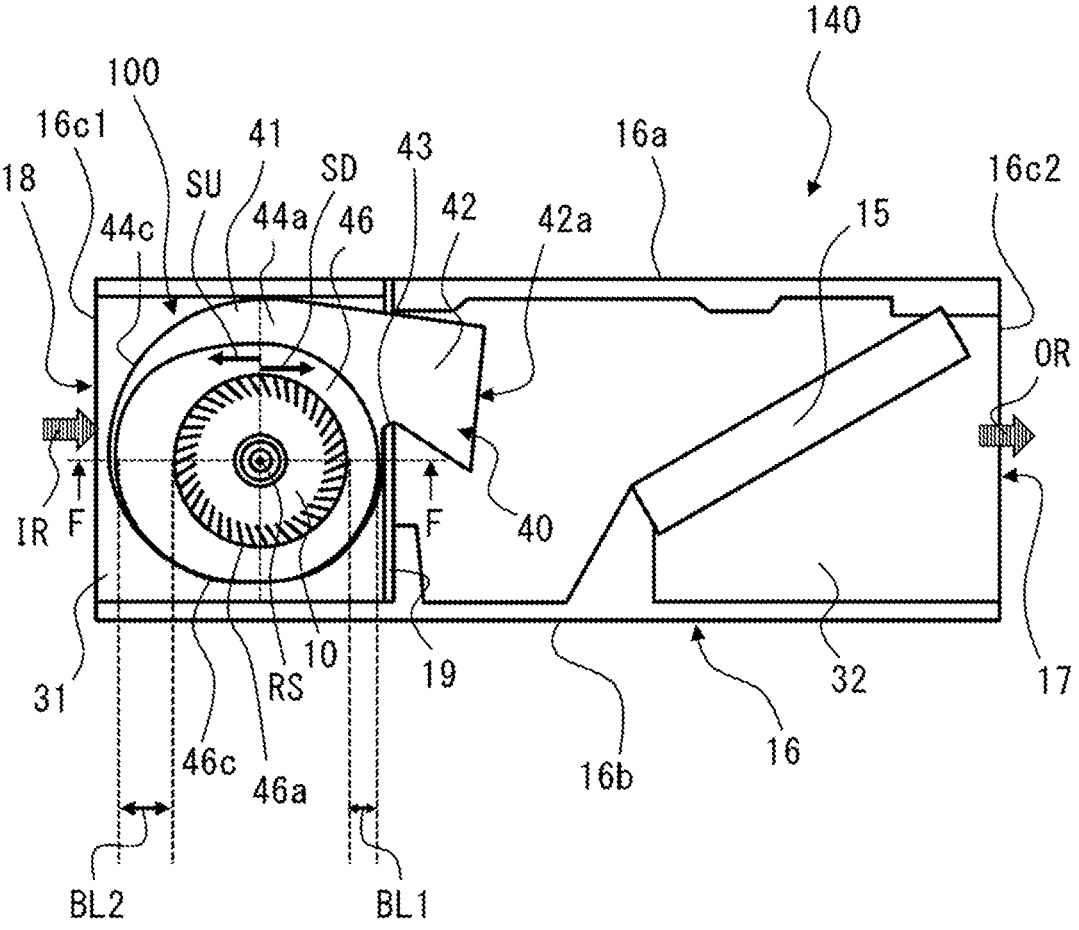
FIG. 28 is a side view that conceptualistically illustrates an example of an internal configuration of the air-conditioning apparatus according to Embodiment 6.

FIG. 26 is a perspective view that illustrates an example of an air-conditioning apparatus 140 according to Embodiment 6. FIG. 27 is a perspective view that illustrates an example of an internal configuration of the air-conditioning apparatus 140 according to Embodiment 6. FIG. 28 is a side view that conceptualistically illustrates an example of an internal configuration of the air-conditioning apparatus 140 according to Embodiment 6. For the centrifugal air-sending device 100 used in the air-conditioning apparatus 140 according to Embodiment 6, components that are the same in configuration as those of the centrifugal air-sending device 100 illustrated in FIG. 1 to FIG. 25 are given the same reference signs and description of such components is omitted. In addition, illustration of a top face portion 16*a* of the air-conditioning apparatus 140 is not provided in FIG. 27 to illustrate the internal configuration of the air-conditioning apparatus 140. The air-conditioning apparatus 140 that includes the centrifugal air-sending device 100 is described below with reference to FIG. 26 to FIG. 28.

The air-conditioning apparatus 140 is configured to condition air in a target space to be air-conditioned by adjusting the temperature and the humidity of sucked air and discharging the air into the target space to be air-conditioned. The air-conditioning apparatus 140 is described as a ceiling-mounted air-conditioning apparatus, which is mounted on a ceiling, and is, however, not limited to such a ceiling-mounted air-conditioning apparatus.

The air-conditioning apparatus 140 has the centrifugal air-sending device 100, the driving source 50, which supplies driving force to the impeller 10 in the centrifugal air-sending device 100, and a heat exchanger 15, which is positioned at a location at which the heat exchanger 15 faces the discharge port 42*a*, which is formed in the scroll casing 40 of the centrifugal air-sending device 100 and through which air is discharged. The air-conditioning apparatus 140 also has a housing 16, which houses the centrifugal air-sending device 100, the driving source 50, and the heat exchanger 15 and is installed in the target space to be air-conditioned. The heat exchanger 15 is only required to be located on the air passage in the housing 16 through which air discharged from the centrifugal air-sending device 100 flows and between the centrifugal air-sending device 100 and a housing outlet port 17, which is described blow. Alternatively, the heat exchanger 15 may not have to face the discharge port 42*a*.

Housing 16

As illustrated in FIG. 26, the housing 16 is formed in a box shape that includes the top face portion 16*a*, a bottom face portion 16*b*, and side face portions 16*c*. The shape of the housing 16 is not limited to the cuboidal shape and may also be another shape such as a circular cylindrical shape, a prismatic shape, a conical shape, a shape that has a plurality of corners, and a shape that has a plurality of curved surfaces. In a case in which the air-conditioning apparatus 140 is a ceiling-mounted air-conditioning apparatus, the housing 16 is installed on a ceiling.

One of the side face portions 16*c* of the housing 16 is an inlet wall portion 16*c*1 in which the housing inlet port 18 is formed. A filter that removes dust from air may also be provided to the housing inlet port 18. One of the side face portions 16*c* of the housing 16 is an outlet wall portion 16*c*2 in which the housing outlet port 17 is formed.

In the housing 16, the inlet wall portion 16*c*1 and the outlet wall portion 16*c*2 form side wall surfaces located opposite to each other across the heat exchanger 15 and the centrifugal air-sending devices 100. The housing inlet port 18 is only required to be formed at a location perpendicular to the axial direction of the rotation axis RS of the centrifugal air-sending device 100. For example, the housing inlet port 18 may also be formed in the bottom face portion 16*b*.

The housing inlet port 18 of the housing 16 is a portion through which air passes and this air is to be sucked from the outside of the housing 16 into the centrifugal air-sending devices 100. The air then flows into an air-sending chamber 31, which is described below. An arrow IR illustrated in FIG. 28 represents air to be sucked through the housing inlet port 18. The housing outlet port 17 of the housing 16 is a portion through which air passes and this air has been discharged from the centrifugal air-sending devices 100 and has passed through the heat exchanger 15. The air has then flowed out from a heat-exchange chamber 32, which is described below. An arrow OR illustrated in FIG. 28 represents air that is being blown out through the housing outlet port 17.

The shape of each of the housing outlet port 17 and the housing inlet port 18 is a rectangular shape as illustrated in FIG. 26 and FIG. 27. The shape of each of the housing outlet port 17 and the housing inlet port 18 is, however, not limited to the rectangular shape and may also be another shape such as a circular shape and an oval shape.

An internal space in the housing 16 is divided by the partition plate 19 into the air-sending chamber 31 in which air is sucked into the scroll casings 40 and the heat-exchange chamber 32 in which air is blown out from the scroll casings 40. The partition plate 19 divides the internal space in the housing 16 into the air-sending chamber 31 in which the impellers 10 are located and the heat-exchange chamber 32 in which the heat exchanger 15 is located.

Driving Source 50

The driving source 50 is, for example, a motor. The driving source 50 is supported by a motor support 9*a*, which is fixed to the housing 16. The driving source 50 has the output shaft 51. The output shaft 51 is a motor shaft and is located such that the output shaft 51 extends parallel to the inlet wall portion 16*c*1 in which the housing inlet port 18 is formed and the outlet wall portion 16*c*2 in which the housing outlet port 17 is formed.

Centrifugal Air-Sending Device 100

The centrifugal air-sending device 100 has the impeller 10 and the scroll casing 40 in which the bell mouth 46 is formed. The centrifugal air-sending device 100 is the centrifugal air-sending device 100 according to Embodiment 1 and Embodiment 5. In the centrifugal air-sending device 100, as illustrated in FIG. 28, the scroll casing 40 is fixed to the partition plate 19, the discharge portion 42 is located in the heat-exchange chamber 32, and the scroll portion 41 is located in the air-sending chamber 31.

As illustrated in FIG. 28, the inlet wall portion 16*c*1 in which the housing inlet port 18 is formed and the partition plate 19 are located opposite to each other and the tongue portion 43 of the scroll casing 40 is located between the inlet wall portion 16*c*1 and the partition plate 19 and in the vicinity of partition plate 19. In the centrifugal air-sending device 100, as illustrated in FIG. 28, a portion that forms the tongue portion 43 and the partition plate 19 may also be fixed to each other, and, alternatively, a portion between the tongue portion 43 and the discharge port 42*a* and the partition plate 19 may also be fixed to each other.

As illustrated in FIG. 27, the air-conditioning apparatus 140 has the respective impellers 10 in the two centrifugal air-sending devices 100, which are attached to the output shaft 51. The centrifugal air-sending devices 100, which each have the impeller 10, form an airflow that is sucked into the housing 16 through the housing inlet port 18 and is blown out through the housing outlet port 17 into the target space to be air-conditioned. The number of the centrifugal air-sending devices 100 located in the housing 16 is not limited to two and may also be one or three or more.

As illustrated in FIG. 28, the scroll casing 40 has the circumferential wall 44*c*, which faces the housing inlet port 18. No other component is located between the circumferential wall 44*c*, which faces the housing inlet port 18, and the housing inlet port 18 and the circumferential wall 44*c* thus directly faces the housing inlet port 18.

Heat Exchanger 15

The heat exchanger 15 is, as described above, positioned at a location at which the heat exchanger 15 faces the discharge port 42*a* of the centrifugal air-sending device 100. The heat exchanger 15 is also located in the housing 16 and on an air passage through which air is discharged from the centrifugal air-sending device 100. The heat exchanger 15 adjusts the temperature of air that is sucked into the housing 16 through the housing inlet port 18 and is then blown out through the housing outlet port 17 into the target space to be air-conditioned. To the heat exchanger 15, a heat exchanger that has a publicly-known structure is applicable.

In the air-conditioning apparatus 140, from the housing inlet port 18 to the housing outlet port 17 of the air-conditioning apparatus 140, the housing inlet port 18, the scroll casing 40 of the centrifugal air-sending devices 100, the heat exchanger 15, and the housing outlet port 17 are sequentially arranged. In a case in which the air-conditioning apparatus 140 is a ceiling-mounted air-conditioning apparatus, these components are arranged along a horizontal direction.

Figure 29:
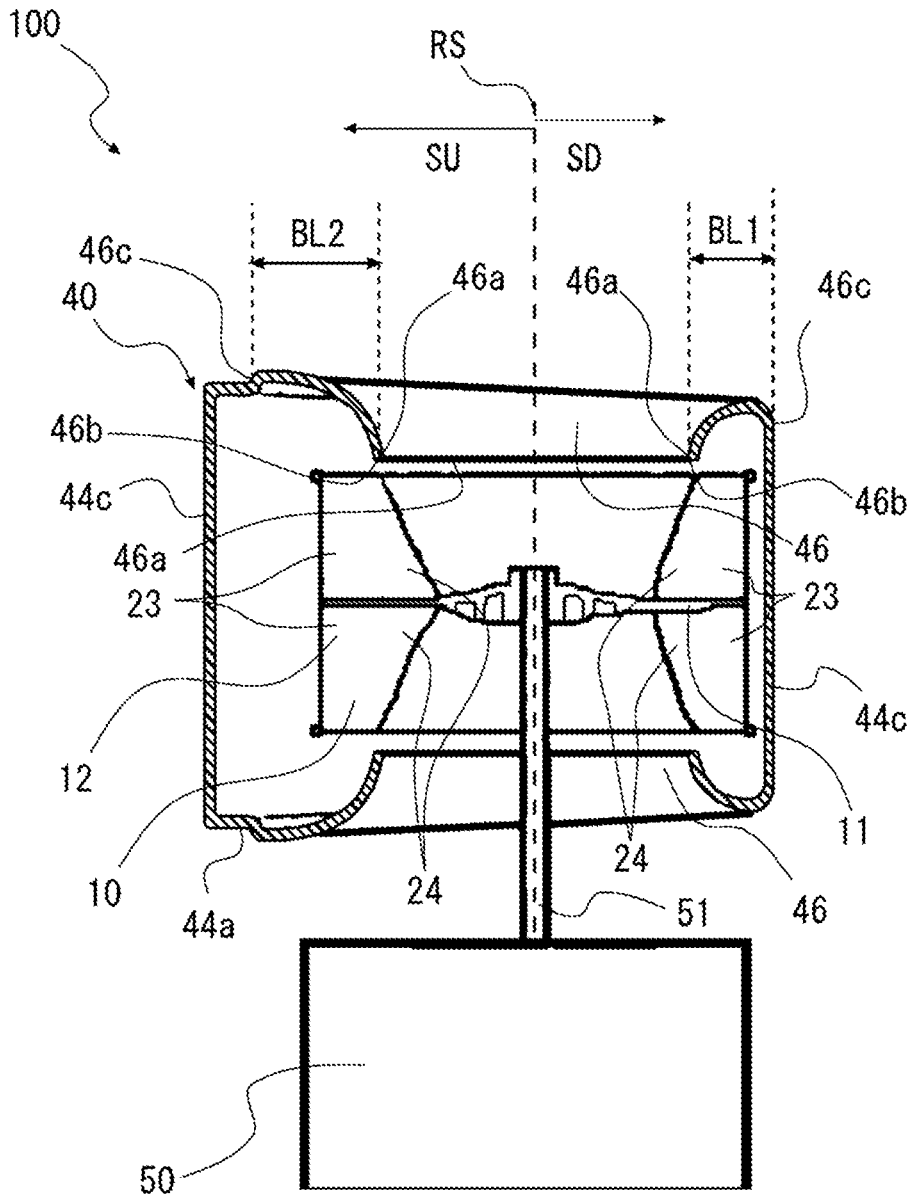
FIG. 29 is a sectional view that illustrates a section of the centrifugal air-sending device illustrated in FIG. 28 taken along line F-F.

FIG. 29 is a sectional view that illustrates a section of the centrifugal air-sending device 100 illustrated in FIG. 28 taken along line F-F. An configuration of the centrifugal air-sending device 100 located in the air-conditioning apparatus 140 is further described in detail below with reference to FIG. 28 FIG. 29.

As illustrated in FIG. 28, in a case in which the centrifugal air-sending device 100 is viewed in the axial direction of the rotation axis RS, a portion divided by the rotation axis RS and in which the tongue portion 43 is located is defined as a tongue-portion including section SD and a portion divided by the rotation axis RS and located closer to the housing inlet port 18 than is the tongue-portion including section SD is defined as an inlet-port facing section SU.

In addition, as illustrated in FIG. 28 and FIG. 29, a distance between the inner circumferential edge portion 46*a* and an outer circumferential edge portion 46*c* of the bell mouth 46 in a radial direction from the rotation axis RS in the tongue-portion including section SD is defined as a first distance BL1. A distance between the inner circumferential edge portion 46*a* and the outer circumferential edge portion 46*c* of the bell mouth 46 in a radial direction from the rotation axis RS in the inlet-port facing section SU is also defined as a second distance BL2. The inner circumferential edge portion 46*a* is an edge portion of the bell mouth 46, which is ring-shaped and located at the inner circumference of the bell mouth 46. The outer circumferential edge portion 46*c* is an edge portion of the bell mouth 46, which is ring-shaped and located at the outer circumference of the bell mouth 46.

The first distance BL1 is, for example, a distance between the inner circumferential edge portion 46*a* and the outer circumferential edge portion 46*c* of the bell mouth 46 at locations in which the rotation axis RS and the inlet wall portion 16*c*1 are closest to each other with a minimum possible distance in between. The second distance BL2 is also a distance between the inner circumferential edge portion 46*a* and the outer circumferential edge portion 46*c* of the bell mouth 46 at locations in which the rotation axis RS and the partition plate 19 are closest to each other with a minimum possible distance in between.

In a case in which the first distance BL1 and the second distance BL2 are defined as described above, the scroll casing 40 of the centrifugal air-sending device 100 is formed such that the first distance BL1 is smaller than the second distance BL2. In particular, the scroll casing 40 of the centrifugal air-sending device 100 is formed such that a maximum possible value of the first distance BL1 is smaller than a maximum possible value of the second distance BL2.

Example of Operation of Air-Conditioning Apparatus 140

When the driving source 50 drives the impellers 10 to rotate, air in the target space to be air-conditioned is sucked into the housing 16 through the housing inlet port 18. The air sucked into the housing 16 flows along the bell mouths 46 and sucked into the impellers 10. The air sucked into the impellers 10 is blown out outward in the radial directions of each of the impellers 10.

The air blown out from the impellers 10 is increased in pressure while the air is passing through the insides of the scroll casings 40. The air whose pressure is increased is blown out from the scroll casings 40 through the discharge ports 42*a*, and then is supplied to the heat exchanger 15. The air supplied to the heat exchanger 15 has its temperature and humidity adjusted by exchanging heat with a heat-exchange medium, such as refrigerant, that flows inside the heat exchanger 15 when the air is passing through the heat exchanger 15. The air that has passed through the heat exchanger 15 is blown out through the housing outlet port 17 into the target space to be air-conditioned.

Action and Advantageous Effects of Air-Conditioning Apparatus 140

A portion of the bell mouth 46 in the inlet-port facing section SU faces the housing inlet port 18 and an airflow thus passes at higher wind velocity along a wall face of the portion of the bell mouth 46 in the inlet-port facing section SU than an airflow that passes a wall face of a portion of the bell mouth 46 in the tongue-portion including section SD. An airflow with high wind velocity is more easily separated from a wall face of the bell mouth 46 than an airflow with low wind velocity.

The air-conditioning apparatus 140 is formed such that, at the scroll casing 40, the first distance BL1 is smaller than the second distance BL2. The radial length of the wall face of the bell mouth 46 in the inlet-port facing section SU is designed to be great and the centrifugal air-sending device 100 is thus configured to cause an airflow with high wind velocity to flow along a wall face of the bell mouth 46. The centrifugal air-sending device 100, which is configured to cause an airflow with high wind velocity to flow along a wall face of the bell mouth 46, is configured to further reduce separation of an airflow with high wind velocity in comparison with a centrifugal air-sending device that do not have the configuration described above.

As a result, an airflow with high wind velocity that flows from the outside into the inside of the scroll casing 40 along the bell mouth 46 collides with the turbo vane portions 24, which protrude toward the inner circumference of the bell mouth 46. The turbo vane portions 24 each have a smaller outlet angle and are each a portion at which an airflow passes at decreased inflow velocity in comparison with the sirocco vane portions 23. The centrifugal air-sending device 100 with the turbo vane portions 24 is thus configured to cause an airflow to pass into the impeller 10 at low loss, reduce power consumption, and increase efficiency. The centrifugal air-sending device 100 with the turbo vane portions 24 is configured to cause an inflow angle of an airflow to be adjusted to reduce collision of the airflow with the blades 12 and thus improve static pressure efficiency.

The air-conditioning apparatus 140 according to Embodiment 6 has the centrifugal air-sending device 100 according to Embodiment 1 to Embodiment 5. The air-conditioning apparatus 140 is thus configured to produce the same advantageous effects as the centrifugal air-sending device 100 according to Embodiment 1 to Embodiment 5.

Embodiment 7

Air-Conditioning Apparatus 140

Figure 30:
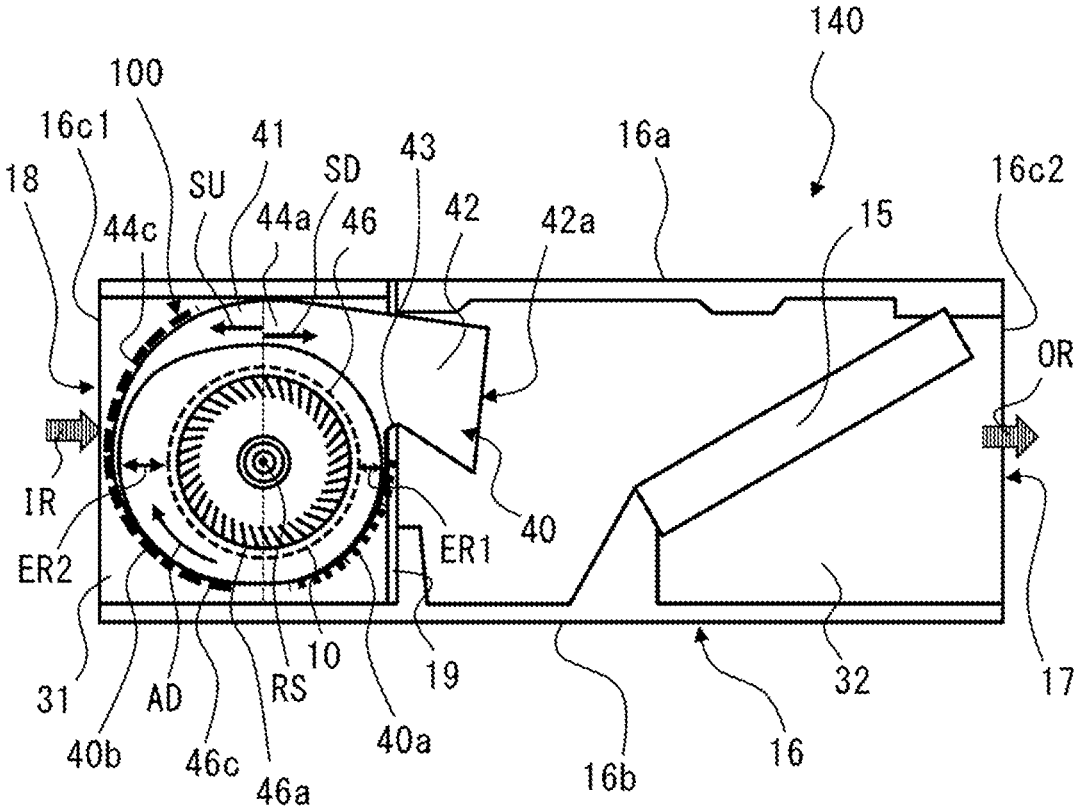
FIG. 30 is a side view that conceptualistically illustrates an example of an internal configuration of an air-conditioning apparatus according to Embodiment 7.

FIG. 30 is a side view that conceptualistically illustrates an example of an internal configuration of an air-conditioning apparatus 140 according to Embodiment 7. For the centrifugal air-sending device 100 used in the air-conditioning apparatus 140 according to Embodiment 7, components that are the same in configuration as those of the centrifugal air-sending device 100 illustrated in FIG. 1 to FIG. 29 are given the same reference signs and description of such components is omitted. The air-conditioning apparatus 140 according to Embodiment 7 may also has the same configuration as the air-conditioning apparatus 140 according to Embodiment 6. The air-conditioning apparatus 140 according to Embodiment 7 is described below with reference to FIG. 30.

In a direction AD in which air flows between the impeller 10 and the circumferential wall 44*c*, a ratio at which a distance between the impeller 10 and the circumferential wall 44*c* is increased from an upstream portion toward a downstream portion is defined as a scroll enlargement ratio. In addition, the scroll enlargement ratio at a scroll casing 40*a* in the tongue-portion including section SD is defined as a first enlargement ratio ER1 and the scroll enlargement ratio at a scroll casing 40*b* in the inlet-port facing section SU is defined as a second enlargement ratio ER2.

The scroll casing 40 in the air-conditioning apparatus 140 according to Embodiment 7 is formed such that the second enlargement ratio ER2 is higher than the first enlargement ratio ER1.

Action and Advantageous Effects of Air-Conditioning Apparatus 140

The scroll casing 40 in the air-conditioning apparatus 140 according to Embodiment 7 is formed such that the second enlargement ratio ER2 is higher than the first enlargement ratio ER1. In other words, in the air-conditioning apparatus 140, the scroll enlargement ratio at a portion of the scroll casing 40 that faces the housing inlet port 18 is higher than the scroll enlargement ratio at a portion of the scroll casing 40 that includes the tongue portion 43.

A portion of the bell mouth 46 in the inlet-port facing section SU faces the housing inlet port 18 and air thus easily flows into the scroll casing 40 and an more amount of air flows into the scroll casing 40 through the portion of the bell mouth 46 in the inlet-port facing section SU than a portion of the bell mouth 46 in the tongue-portion including section SD. The air-conditioning apparatus 140, which has a configuration in which, to such a relationship of the flow rate of air, the scroll enlargement ratio at the portion that faces the housing inlet port 18 is higher than the scroll enlargement ratio at the portion that includes the tongue portion 43, is configured to increase pressure recovery in comparison with the air-conditioning apparatus that does not have the configuration described above. In addition, the air-conditioning apparatus 140, which has a configuration in which the scroll enlargement ratio at the portion that faces the housing inlet port 18 is higher than the scroll enlargement ratio at the portion that includes the tongue portion 43 and in which the turbo vane portions 24 protrude toward the inner circumference of the bell mouth 46, is configured to accelerate an inflow of air and further increase efficiency.

In addition, an airflow with high wind velocity that passes from the outside into the inside of the scroll casing 40 along the bell mouth 46 collides with the turbo vane portions 24, which protrude toward the inner circumference of the bell mouth 46. The turbo vane portions 24 each have a smaller outlet angle and are each a portion at which an airflow passes at decreased inflow velocity in comparison with the sirocco vane portions 23. The centrifugal air-sending device 100 with the turbo vane portions 24 is thus configured to cause an airflow to pass into the impeller 10 at low loss, reduce power consumption, and increase efficiency.

The air-conditioning apparatus 140 according to Embodiment 7 has the centrifugal air-sending device 100 according to Embodiment 1 to Embodiment 5. The air-conditioning apparatus 140 is thus configured to produce the same advantageous effects as the centrifugal air-sending device 100 according to Embodiment 1 to Embodiment 5.

Ones of Embodiment 1 to Embodiment 7 described above may also be combined with each other and may also be implemented. The configurations of the embodiments described above are merely an example. These configurations may also be combined with other known technique, or may also be partially omitted or changed unless the configurations depart from their scope. For example, in Embodiment 1, the blades are each formed such that the vane length is continuously changed from the main plate 11 to the corresponding one of the side plates 13. The blades may also have a portion that is located between the main plate 11 and the corresponding one of the side plates 13 and at which the vane length is constant, that is, a portion at which the inner diameter ID is constant and is not inclined to the rotation axis RS.

REFERENCE SIGNS LIST

9*a*: motor support, 10: impeller, 10L: impeller, 10*a*: outer circumferential side face, 10*e*: air inlet, 11: main plate, 11*b*: boss portion, 11*b*1: shaft hole, 12: blade, 12A: first blade, 12A1: first sirocco vane portion, 12A11: first sirocco region, 12A2: first turbo vane portion, 12A21: first turbo region, 12A21*a*: first turbo region, 12A2*a*: first turbo vane portion, 12A3: first radial vane portion, 12B: second blade, 12B1: second sirocco vane portion, 12B11: second sirocco region, 12B2: second turbo vane portion, 12B21: second turbo region, 12B21*a*: second turbo region, 12B2*a*: second turbo vane portion, 12B3: second radial vane portion, 12F: end portion, 13: side plate, 13*a*: first side plate, 13*b*: second side plate, 14A: inner circumferential end, 14A1: leading edge, 14B: inner circumferential end, 14B1: leading edge, 15: heat exchanger, 15A: outer circumferential end, 15A1: trailing edge, 15B: outer circumferential end, 15B1: trailing edge, 16: housing, 16*a*: top face portion, 16*b*: bottom face portion, 16*c*: side face portion, 16*c*1: inlet wall portion, 16*c*2: outlet wall portion, 17: housing outlet port, 18: housing inlet port, 19: partition plate, 22: blade inner portion, 23: sirocco vane portion, 23*a*: outer sirocco vane portion, 24: turbo vane portion, 24*a*: outer turbo vane portion, 25: separation portion, 25*a*: separation portion, 26: outer circumferential region portion, 28: blade outer circumferential portion, 31: air-sending chamber, 32: heat-exchange chamber, 40: scroll casing, 40*a*: scroll casing, 40*b*: scroll casing, 41: scroll portion, 41*a*: scroll start portion, 41*b*: scroll end portion, 42: discharge portion, 42*a*: discharge port, 42*b*: extension plate, 42*c*: diffuser plate, 42*d*: first side plate portion, 42*e*: second side plate portion, 43: tongue portion, 44*a*: side wall, 44*a*1: first side wall, 44*a*2: second side wall, 44*c*: circumferential wall, 45: suction port, 45*a*: first suction port, 45*b*: second suction port, 46: bell mouth, 46*a*: inner circumferential edge portion, 46*b*: inner circumferential side end portion, 46*c*: outer circumferential edge portion, 50: driving source, 51: output shaft, 71: first flat surface, 72: second flat surface, 100: centrifugal air-sending device, 100L: centrifugal air-sending device, 112*a*: first vane portion, 112*b*: second vane portion, 122*a*: main-plate-side blade region, 122*b*: side-plate-side blade region, 140: air-conditioning apparatus, 141A: inclination portion, 141B: inclination portion, AD: direction, AR: airflow, BI: inner diameter, BL1: first distance, BL2: second distance, C1: circle, C1*a*: circle, C2: circle, C2*a*: circle, C3: circle, C3*a*: circle, C4: circle, C5: circle, C7: circle, C7*a*: circle, C8: circle, CD: circumferential direction, CL1: center line, CL2: center line, CL3: center line, CL4: center line, E: range, ER1: first enlargement ratio, ER2: second enlargement ratio, ID1: inner diameter, ID1*a*: inner diameter, ID2: inner diameter, ID2*a*: inner diameter, ID3: inner diameter, ID3*a*: inner diameter, ID4: inner diameter, ID4*a*: inner diameter, IR: arrow, L: open arrow, L1*a*: vane length, L1*b*: vane length, L2*a*: vane length, L2*b*: vane length, MP: intermediate position, MS: distance, OD: blade outer diameter, OD1: outer diameter, OD2: outer diameter, OD3: outer diameter, OD4: outer diameter, OR: arrow, R: rotation direction, RS: rotation axis, SD: tongue-portion including section, SL: distance, SU: inlet-port facing section, T: vane thickness, TL1: tangent line, TL2: tangent line, TL3: tangent line, TL4: tangent line, V: point of sight, W: width dimension, WI: blade inner diameter, WS: region, a1: outlet angle, α2: outlet angle, β1: outlet angle, β2: outlet angle

The invention claimed is:

1. A centrifugal air-sending device comprising:

an impeller that has a main plate that is to be driven to rotate, a side plate that is ring-shaped and located such that the side plate faces the main plate, and a plurality of blades that each have one end connected to the main plate and an other end connected to the side plate and are arranged in a circumferential direction centered on a rotation axis of the main plate that is virtual; and a scroll casing that houses the impeller and has a circumferential wall that is scroll-shaped and a side wall that has a bell mouth that forms a suction port that communicates with a space defined by the main plate and the plurality of blades, the plurality of blades each having an inner circumferential end that is closer to the rotation axis than is an outer circumferential end in a radial direction centered on the rotation axis, the outer circumferential end that is closer to an outer circumference than is the inner circumferential end in the radial direction, a sirocco vane portion that includes the outer circumferential end and forms a forward-curved blade at which an outlet angle is formed larger than 90 degrees, a turbo vane portion that includes the inner circumferential end and forms a backward-curved blade, a first region that is located closer to the main plate than is an intermediate position between the main plate and the side plate in an axial direction of the rotation axis, and a second region that is located closer to the side plate than is the first region, the plurality of blades each having a vane length in the first region that is greater than a vane length in the second region, the plurality of blades being each formed such that a proportion for which the turbo vane portion accounts is higher in the radial direction than a proportion for which the sirocco vane portion accounts in the first region and the second region, in a case in which portions of the plurality of blades that are located closer to the outer circumference than is a blade inner diameter of the respective inner circumferential ends of the plurality of blades at end portions of the plurality of blades that are close to the side plate in the axial direction are defined as a blade outer circumferential portion, the blade outer circumferential portion is formed such that a vane thickness of each of the plurality of blades is decreased in the radial direction from an inner circumference toward the outer circumference.

2. The centrifugal air-sending device of claim 1, wherein the centrifugal air-sending device is formed such that the vane thickness at each of only the sirocco vane portions of the plurality of blades is decreased in the radial direction from the inner circumference toward the outer circumference.

3. The centrifugal air-sending device of claim 1, wherein the plurality of blades are formed such that the vane thickness at each of the turbo vane portions of the plurality of blades is constant in each section in the axial direction from the inner circumference toward the outer circumference of the impeller.

4. The centrifugal air-sending device of claim 1, wherein the plurality of blades are each formed such that the turbo vane portion and the sirocco vane portion are separated from each other in the radial direction.

5. The centrifugal air-sending device of claim 1, wherein the plurality of blades are each formed such that a blade outer diameter of the respective outer circumferential ends of the plurality of blades is larger than an inner diameter of the bell mouth, and, in a case in which portions of the plurality of blades that are located closer to the outer circumference than is an inner circumferential side end portion that is an end portion of the bell mouth that is located closest to the inner circumference in the radial direction are defined as an outer circumferential region portion, the outer circumferential region portion is formed such that the proportion for which the sirocco vane portion accounts is higher in the radial direction than the proportion for which the turbo vane portion accounts in the first region and the second region.

6. An air-conditioning apparatus comprising the centrifugal air-sending device of claim 1.

7. An air-conditioning apparatus, comprising:

the centrifugal air-sending device of claim 1;

a heat exchanger located such that the heat exchanger faces the centrifugal air-sending device; and a housing that houses the centrifugal air-sending device and the heat exchanger and in which a housing inlet port through which air that is to be sucked into the centrifugal air-sending device flows is formed and a housing outlet port through which air that is discharged from the centrifugal air-sending device and has passed through the heat exchanger flows is formed, wherein the scroll casing has a tongue portion that separates an airflow blown out from the impeller, and, in a case in which the centrifugal air-sending device is viewed in the axial direction of the rotation axis, a portion divided by the rotation axis and in which the tongue portion is located is defined as a tongue-portion including section and a portion divided by the rotation axis and located closer to the housing inlet port than is the tongue-portion including section is defined as an inlet-port facing section, and a distance between an inner circumferential edge portion and an outer circumferential edge portion of the bell mouth in the radial direction in the tongue-portion including section is defined as a first distance and a distance between the inner circumferential edge portion and the outer circumferential edge portion of the bell mouth in the radial direction in the inlet-port facing section is defined as a second distance, the scroll casing is formed such that the first distance is smaller than the second distance.

8. The air-conditioning apparatus of claim 7, wherein, in a direction in which air flows between the impeller and the circumferential wall, a ratio at which a distance between the impeller and the circumferential wall is increased from an upstream portion toward a downstream portion is defined as a scroll enlargement ratio, the scroll enlargement ratio at a portion of the scroll casing in the tongue-portion including section is defined as a first enlargement ratio, and the scroll enlargement ratio at a portion of the scroll casing in the inlet-port facing section is defined as a second enlargement ratio, the scroll casing is formed such that the second enlargement ratio is higher than the first enlargement ratio.

9. An air-conditioning apparatus, comprising:

the centrifugal air-sending device of claim 1;

a heat exchanger located such that the heat exchanger faces the centrifugal air-sending device; and a housing that houses the centrifugal air-sending device and the heat exchanger and in which a housing inlet port through which air that is to be sucked into the centrifugal air-sending device flows is formed and a housing outlet port through which air that is discharged from the centrifugal air-sending device and has passed through the heat exchanger flows is formed, wherein the scroll casing has a tongue portion that separates an airflow blown out from the impeller, and, in a case in which the centrifugal air-sending device is viewed in the axial direction of the rotation axis, a portion divided by the rotation axis and in which the tongue portion is located is defined as a tongue-portion including section and a portion divided by the rotation axis and located closer to the housing inlet port than is the tongue-portion including section is defined as an inlet-port facing section, and, in a direction in which air flows between the impeller and the circumferential wall, a ratio at which a distance between the impeller and the circumferential wall is increased from an upstream portion toward a downstream portion is defined as a scroll enlargement ratio, the scroll enlargement ratio at a portion of the scroll casing in the tongue-portion including section is defined as a first enlargement ratio, and the scroll enlargement ratio at a portion of the scroll casing in the inlet-port facing section is defined as a second enlargement ratio, the scroll casing is formed such that the second enlargement ratio is higher than the first enlargement ratio.

* * * * *